US006551216B2

(12) United States Patent
Rennex

(10) Patent No.: US 6,551,216 B2
(45) Date of Patent: Apr. 22, 2003

(54) ULTRA-LIGHT ROCK-CLIMBING WALL

(75) Inventor: Brian George Rennex, Gaithersburg, MD (US)

(73) Assignee: Brian G. Rennex, Rockville, MD (US)

( * ) Notice: Subject to any disclaimer, the term of this patent is extended or adjusted under 35 U.S.C. 154(b) by 0 days.

(21) Appl. No.: 09/902,785

(22) Filed: Jul. 12, 2001

(65) Prior Publication Data

US 2003/0013579 A1 Jan. 16, 2003

(51) Int. Cl.[7] ..... A63B 9/00; A63B 17/00

(52) U.S. Cl. ..... 482/35; 482/36; 482/37; 482/38

(58) Field of Search ..... 482/35–37, 24; 182/40, 41, 48, 49, 137–140; D29/108

(56) References Cited

U.S. PATENT DOCUMENTS

| | | | | | |
|---|---|---|---|---|---|
| 1,676,061 | A | * | 7/1928 | Strom | 482/23 |
| 3,008,711 | A | * | 11/1961 | Dillon | 482/35 |
| 3,642,277 | A | * | 2/1972 | Gersten | 272/60 |
| 4,161,998 | A | * | 7/1979 | Trimble | 182/190 |
| 4,546,965 | A | | 10/1985 | Baxter | |
| 5,161,641 | A | * | 11/1992 | Nusbaum | 182/138 |
| 5,226,864 | A | | 7/1993 | Showers | |
| 5,247,902 | A | * | 9/1993 | Williams | 119/706 |
| 5,299,654 | A | * | 4/1994 | Duncan | 182/138 |
| 5,330,400 | A | * | 7/1994 | Huberman | 482/35 |
| 5,343,980 | A | * | 9/1994 | Elfanbaum | 182/199 |
| 5,405,304 | A | | 4/1995 | Petersheim | |
| 5,732,954 | A | * | 3/1998 | Strickler et al. | 273/441 |
| 5,806,624 | A | * | 9/1998 | Nordtvedt | 182/48 |
| 5,941,041 | A | | 8/1999 | Robinson | |
| 5,984,837 | A | * | 11/1999 | Weaver et al. | 482/35 |
| 6,095,950 | A | * | 8/2000 | Katz | 482/35 |
| 6,174,266 | B1 | * | 1/2001 | Merrill | 482/35 |

FOREIGN PATENT DOCUMENTS

| | | | | |
|---|---|---|---|---|
| DE | 2927-546 | * | 1/1981 | 482/35 |
| WO | 89/05173 | * | 6/1989 | |

* cited by examiner

*Primary Examiner*—Jerome W. Donnelly
*Assistant Examiner*—Lori Baker Amerson

(57) ABSTRACT

A rock-climbing structure including one or more pliable climbing matrices held under tension and a plurality of rock-climbing/gymnastic holds attached to the pliable climbing matrices. In an embodiment of the invention, a climbing matrix is, for example, a net or sheet. The plurality of holds can be attached to the one or more pliable climbing matrices by, for example, clasp rods that clamp a matrix or by clamps that engage a cord of the matrix. In an embodiment of the invention, distances between each hold of the plurality of holds vary across a climbing matrix to create a varied climbing route. The holds can include, for example, a hold edge, a jib hold, a hold hole, a hold lip, a hold crack, or a hold boss.

33 Claims, 30 Drawing Sheets

| | hold type | x | y |
|---|---|---|---|
| 1. | a | 2.7 | 1.2 |
| 2. | b | 1.8 | 2.0 |
| 3. | c | 2.2 | 3.7 |
| 4. | d | 1.8 | 4.5 |
| 5. | c | 3.4 | 4.7 |
| 6. | f | 4.5 | 5.0 |
| 7. | b | 5.7 | 5.7 |
| 8. | a | 2.3 | 6.2 |
| 9. | b | 3.3 | 6.2 |
| 10. | c | 3.3 | 3.3 |
| 11. | d | 3.7 | 6.7 |

ULTRA-LIGHT ROCK-CLIMBING WALL

BACKGROUND OF THE INVENTION

This invention teaches a novel ultra-light rock-climbing wall comprising a pliable climbing-wall matrix upon which rock/gymnastic-climbing holds are mounted at variable spacings. A pliable climbing-wall matrix is defined to be sufficiently thin and supple to be folded or rolled up for storage. Examples include fabric, mesh, netting, and thin, supple solid sheets or meshes. This invention also teaches various climbing-wall structures featuring pliable climbing-wall matrices. The term "rock climbing" refers to climbing via variable, positionable climbing holds on steep or overhanging climbing surfaces or matrices—as is practiced on rock-climbing cliffs and in rock-climbing gyms. This invention also teaches the use of "safety surfaces" which are located beneath and rise up following climbing surfaces at a safe distance—to prevent falling injury and eliminate the need for safety ropes. The preferred embodiment features a mesh climbing matrix and a net safety surface both of which are stretched from ground anchors over centrally positioned support poles.

The combination of a mesh climbing matrix and rock-climbing/gymnastic holds leads to a product featuring low cost, very light weight, easy assembly, convenient storage in a small space, and challenging rock climbing. To achieve convenient storage one must utilize minimal structural elements along with fabric or net climbing/safety surfaces. Challenging climbing is guaranteed with varied rock-climbing/gymnastic holds on steep surfaces and on the underside of overhanging walls, and the safety surfaces are sufficiently compliant to safely break a fall. The smallest versions of this invention would be portable and storable in a closet space, medium-sized versions could be stored in a back yard or shed, and large versions could be used in indoor gyms or amusement parks.

Prior art rock-climbing walls utilize rigid, heavy, expensive panels with attached rock-climbing holds; this is true even for the portable versions. Prior children's climbing playgrounds do not provide for interesting climbing—in the sense that rock climbing can be very challenging, difficult, varied and gymnastic—because they feature climbing surfaces which allow only steep crawling or boring climbing on regular features such as a net or a cable. It should be obvious to anyone who has seen real rock climbing that there is a significant qualitative difference between climbing a fence or a net and climbing a rock climbing wall. The key insight here is that this qualitative difference derives from a structural difference. Namely, rock-climbing/gymnastic holds are affixed to a rock-climbing wall—in which case it is possible to space the holds so that reaching and utilizing the next hold can be difficult and interesting. In addition, it is possible to vary the shape, size, and orientation of the holds—so that both creativity and endurance are needed to complete a climbing route. Finally, in neither of the two prior art categories—(1) rock climbing walls and (2) children's "easy-climbing" playgrounds—is there a provision for "ropeless" climbing in which safety surfaces follow the climbing surfaces in such a way that long climbing routes can be safely climbed without the use of a rope.

The important point, with regard to distinguishing the current patent from prior art, is that the same word, "climbing," is used, both in everyday language and in patent literature, to describe several distinct activities: walking or crawling up a steep incline, climbing steps, climbing a ladder or rope ladder, climbing a net or a rope, and (what is being called in the current patent) "rock climbing." The resulting ambiguity leads to semantic confusion. The solution of this confusion is to carefully define and delineate between these distinct "climbing" activities and to show that these distinctions are based on the details of the structure or surface upon which the particular type of climbing is being done.

The patent of Baxter (1985) [U.S. Pat. No. 4,546,965] discloses a crawling surface for children to crawl up an irregular surface on the top side of two flat panels hinged together and configured in a "pup tent" shape. The important differences between Baxter and the current invention include the following. The restriction to flat panels limits the size of the apparatus in that it cannot be reduced to a size smaller than the flat panels for storage. Also, the use of flat panels as a climbing surface (referred to herein as a climbing matrix upon which holds are mounted) results in a heavy and expensive product. And, there is no integral provision for safety. Furthermore, the restriction of flat panels at two fixed inclines makes this invention unsuitable for challenging and varied climbing. Nor does Baxter teach rock-climbing holds on steep or overhanging climbing surfaces. Consequently, the invention of Baxter is really for crawling. Another patent, of Robinson et al (1999) [U.S. Pat. No. 5,941,041], discloses panels with climbing holds. This construction is not optimally light or storable, and there is no integral provision for safety surfaces.

An example of a playground maze apparatus is disclosed by Showers (1993) [U.S. Pat. No. 5,226,864]. This is essentially a playhouse comprising many cubicles stacked above and beside one another. There are net restraints on the outside of the maze to prevent children from falling to the ground, but these are not high enough to allow climbing. Even if they were high enough to allow climbing, the climbing would be uncomfortable to the fingers and boring, as is the case when we climb a wire fence. Clearly, there is no intent to use the net restraints for climbing. Nor is there any provision for rock-climbing holds which follow a potentially long route on what is referred to as a "climbing surface" in the current patent. Any climbing a child could do would be limited to simply pulling herself through a hole from one cubicle to another, and this does make for interesting, challenging climbing, except perhaps for toddlers. Showers teaches a net on the outer wall of this maze which might be scaled if the mesh were not too fine or sharp, but again such a practice should not be confused with real climbing in which a substantial portion of one's weight is supported by one's fingers and in which the climbs are made interesting by the variety, the spareness, and the difficulty of the rock-climbing holds. Also, there is no real provision for climbing on the outside of the maze, and, if a child were to attempt to scale the outside of the maze, he would be injured since there is no provision for safety surfaces to break a long fall. Furthermore, the "safety surfaces" defined in the specifications of the current patent are designed to catch a vertical fall by yielding while at the same time slowing the fall. The "wall restraints" of Showers do not perform that "safety net" function.

Another example of a playground maze apparatus is disclosed by Petersheim (1995) [U.S. Pat. No. 5,405,304]. In this case netting is strung at a steep angle to allow an infant to crawl/climb from one compartment to another. This netting is intended only for steep crawling; it does not incorporate rock-climbing holds as will be defined later in the specifications of the current patent. Also, the structure is limited in height, or it would be unsafe—in that children could fall from the top of the net to the ground. For these reasons, the structure as shown could not provide for challenging and interesting rock climbing. In addition, the infrastructure is heavy, and could not be easily dissembled.

The patent of Katz (2000) [U.S. Pat. No. 6,095,950] discloses a structure comprising three support poles and attached plates with projections for climbing. This is not nearly as lightweight and portable as the current invention because the attached plates and the associated infrastructure are inherently heavy and not foldable to a small storage space. And, the disassembly would be much more difficult.

The Gennan patent, DE 2927-546 [January, 1981] of Udo and Kohler, teaches a vertical net suspended from a curved rod which extends up from its point of attachment in the ground and then bends over sideways to its attachment to the net, thereby preventing interference between the rod and the children climbing on the net. And, there are various other configurations of poles and nets. This patent has no provision for rock-climbing holds on the nets, and therefore it cannot be used for interesting "rock climbing." Also, there are no safety surfaces, and the climbing surface is restricted to being only a net.

The distinction between climbing a net (as just discussed in the prior patents of Showers, Petersheim, and Udo), and climbing the "climbing surfaces" of the current patent can be better understood as follows. In the current patent, a pliable surface which can be a net (a fabric or a mesh), serves as a climbing matrix upon which are mounted holds of variable difficulty. In the patent of Udo, the climbing matrix is the net, and the net is also used for climbing, but there are no rock-climbing/gymnastic holds. The resulting net-climbing must be boring even if it is strenuous, because the spacing of the strands used for climbing is regular and small, and it is always easy to reach another net strand. Therefore, there is a "climbing-wall" structural difference between the prior art and the current patent, and this difference results in a very different invention and a very different type of activity by users.

SUMMARY

This invention teaches a novel ultra-light rock-climbing wall comprising a pliable climbing-wall matrix upon which rock/gymnastic-climbing holds are mounted at variable spacings. This invention is on the one hand, optimally lightweight and on the other hand, optimally easy to put up, take down, and store. The term "rock climbing" refers to climbing via variably shaped, sized, and spaced climbing holds on steep or overhanging "climbing surfaces"—as is done on climbing cliffs and in climbing gyms. Additional innovative climbing holds incorporated in the current patent include (1) "gymnastic holds" which are defined to include swinging holds and "suspension holds." Suspension holds are suspended in space in a manner that constrains them from swinging. These three types of climbing holds will be collectively referred to as "rock-climbing/gymnastic holds"—in the current patent.

This invention also teaches the use of "safety surfaces" which are an integral part of the rock-climbing playground, and which are located beneath and follow up the climbing surfaces at a safe distance—to prevent injury due to falling, thereby permitting "ropeless" climbing. These safety surfaces are most conveniently made of fabric or netting, which are stretched from ground anchors over support poles. This fabrication uses minimal material and allows minimal storage space, while still permitting challenging climbing. Other embodiments take advantage of pre-existing objects such as fences, trees, or walls to serve as tension anchors (in place of ground anchors) or to serve as supports for the climbing surfaces (comprising a mesh matrix with mounted rock-climbing/gymnastic holds). Finally, the scale of this invention ranges from very small to very large.

DETAILED DESCRIPTION

Figure 1A:
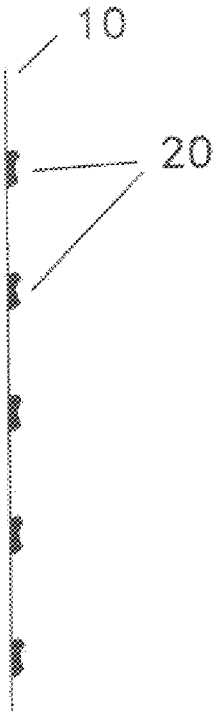
FIGS. 1*a* shows a side view and 1*b* a front view of the ultra-light rock-climbing structure in its first embodiment showing a pliable climbing matrix upon which are mounted rock-climbing/gymnastic holds.
Figure 1B:
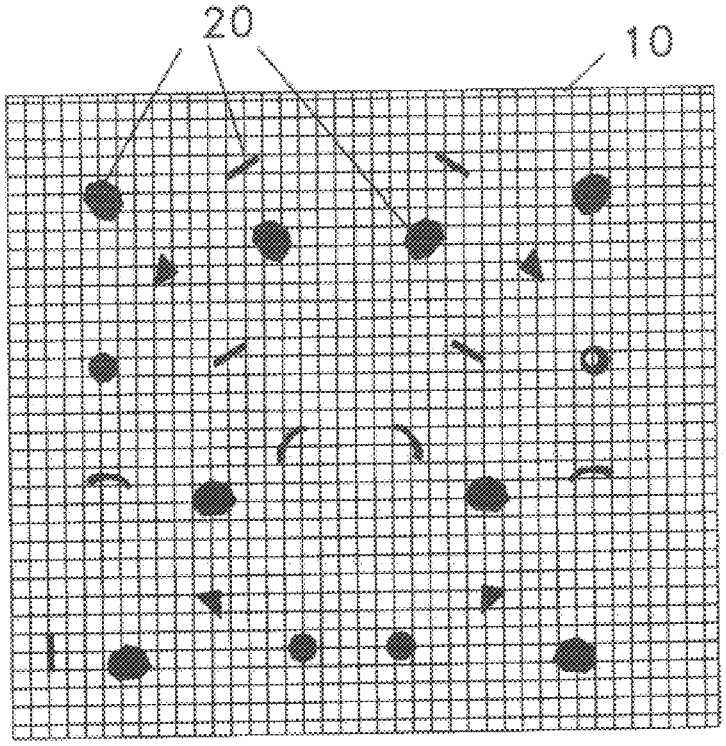

The basic invention is a portable, lightweight, inexpensive climbing wall comprising rock-climbing/gymnastic holds mounted on a climbing matrix. FIGS. 1*a* and 1*b* show a side view and a front view of the ultra-light rock-climbing structure in its first embodiment depicting pliable climbing matrix 10 upon which are mounted rock-climbing/gymnastic holds 20. In this example, pliable climbing matrix 10 is a mesh. It may also be a fabric, a net, or thin, supple solid sheets or meshes, and the mesh strands may be oriented horizontally and vertically or diagonally left and right (like x's). Pliable climbing-wall matrix 10 is defined here to be sufficiently thin and supple to be folded or rolled up for storage; it must also be strong and inelastic enough to support climbers who are climbing on rock-climbing/gymnastic holds 20. Pliable climbing-wall matrix 10 is hung from various support means, as will be depicted throughout this specification.

Figure 2:
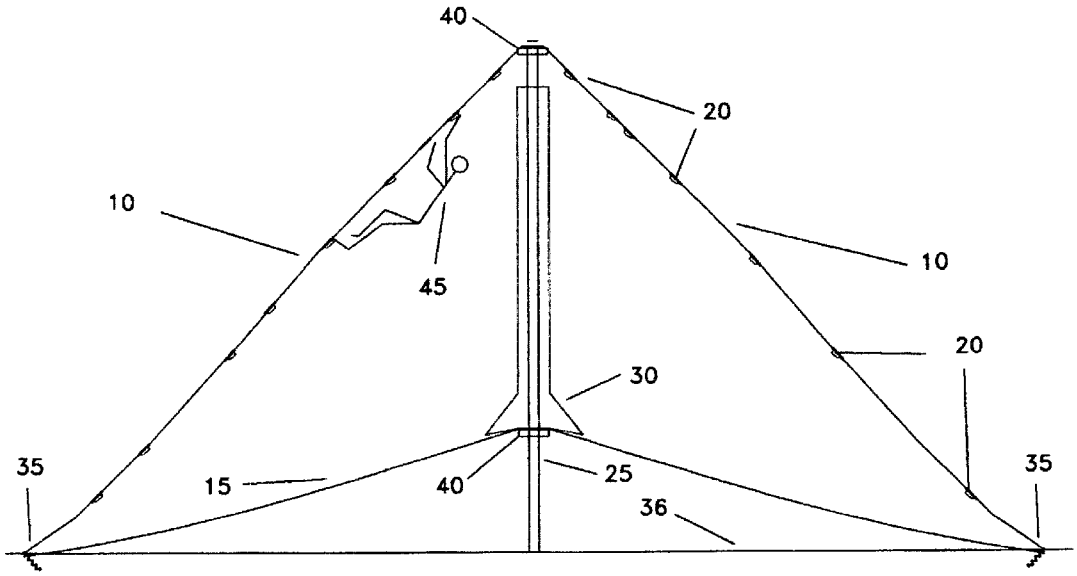
FIG. 2 is a cross-sectional side view of the ultra-light rock-climbing structure in its second embodiment showing a support pole, a pliable climbing matrix, ground anchors, and safety surfaces.

The basic elements of the second embodiment the invention comprise an elevated structure, a pliable climbing matrix, rock-climbing/gymnastic holds, a safety surface, and tension anchors. The pliable climbing matrix and the safety surface are mounted in tension between the elevated structure and the tension anchors. FIG. 2 is a cross-sectional side view of ultra-light rock-climbing structure 5 in its second embodiment. Here the elevated structure is a single support pole 25, but there may be one of more of these. Pliable climbing matrix 10 and safety surface 15, made of a thin pliable material such as a fabric, mesh, or net, are stretched over support pole 25 between ground anchors 35 (the tension anchors) in the ground 36 on opposite sides of support pole 25. Ground anchors 35 may be ground screws, stakes, or bolts with a ring, handle, notch, or hole to attach cables or grommets attached to the edge of pliable climbing matrix 10 and safety surfaces 15. When climber 45 exerts a vertical force on one side (to the left of support pole 25) of pliable climbing matrix 10, the other side (to the right of support pole 25) supports support pole 25 in tension from leaning toward climber 45. Padding 30 protects climber 45 from injury, and attachment rings 40 serve as one way to fixedly attach pliable climbing matrix 10 and safety surface 15 to support pole 25.

Safety surface 15 is defined in the current application as a compliant object located beneath pliable climbing matrix 10 at a prescribed distance and with a commensurate, prescribed compliance so that any fall of climber 45 from any region of pliable climbing matrix 10 will be safely arrested by safety surface 15. This definition is distinct from what is merely a restraint to prevent a person from falling off the edge of a raised floor, an example of which can be found in the prior-art patent of Showers (1993) [U.S. Pat. No. 5,226,864] where net walls prevent a child from falling from raised cubicles. Again, safety surface 15 is used to catch the fall of a person after he has fallen a distance through space. In addition, should pliable climbing matrix 10 rise to a dangerous distance above the ground, safety surface 15 will rise beneath and follow pliable climbing matrix 10 at a safely prescribed distance. Safety nets are the preferred material for safety surfaces 15 for the ultra-light rock-climbing wall, but a safety surface could be made of any compliant (cushioning) material or combinations of infrastructure and compliant material. And, this safety surface could be incorporated in conventional rock climbing walls. That is, the idea of safety surfaces is novel, and can be claimed independently of the ultra-light rock-climbing wall invention.

Pliable climbing matrix 10 is defined in the current patent as having two key aspects: (1) a surface which is sufficiently steep or overhanging as to require that the fingers of climber 45 must support a substantial proportion of her body weight, which proportion may vary from a few percent to a hundred percent and (2) a surface sparsely covered with rock-climbing/gymnastic holds 20 (These are specified in detail in the discussion of FIGS. 18–21.) The size, shape, and spacing of rock-climbing/gymnastic holds 20 can be varied to make climbing more difficult, interesting, and challenging. In the event that the holds are more densely distributed on pliable climbing matrix 10, provision can be made to mark or tape a subset of these holds—to define a climbing route which is effectively sparse. This definition is distinct from walking or crawling up a shallow incline, from climbing steps or ladders, from pulling oneself through a cubicle hole, or from climbing a rope or net. And, this definition distinguishes the current patent from the prior art examples of children's "climbing" playgrounds. An important difference between a safety surface and a pliable climbing matrix, in general, is that a safety surface should be compliant or elastic whereas a pliable climbing matrix should be as non-elastic as possible—to reduce sagging under a climber's weight.

Figure 3:
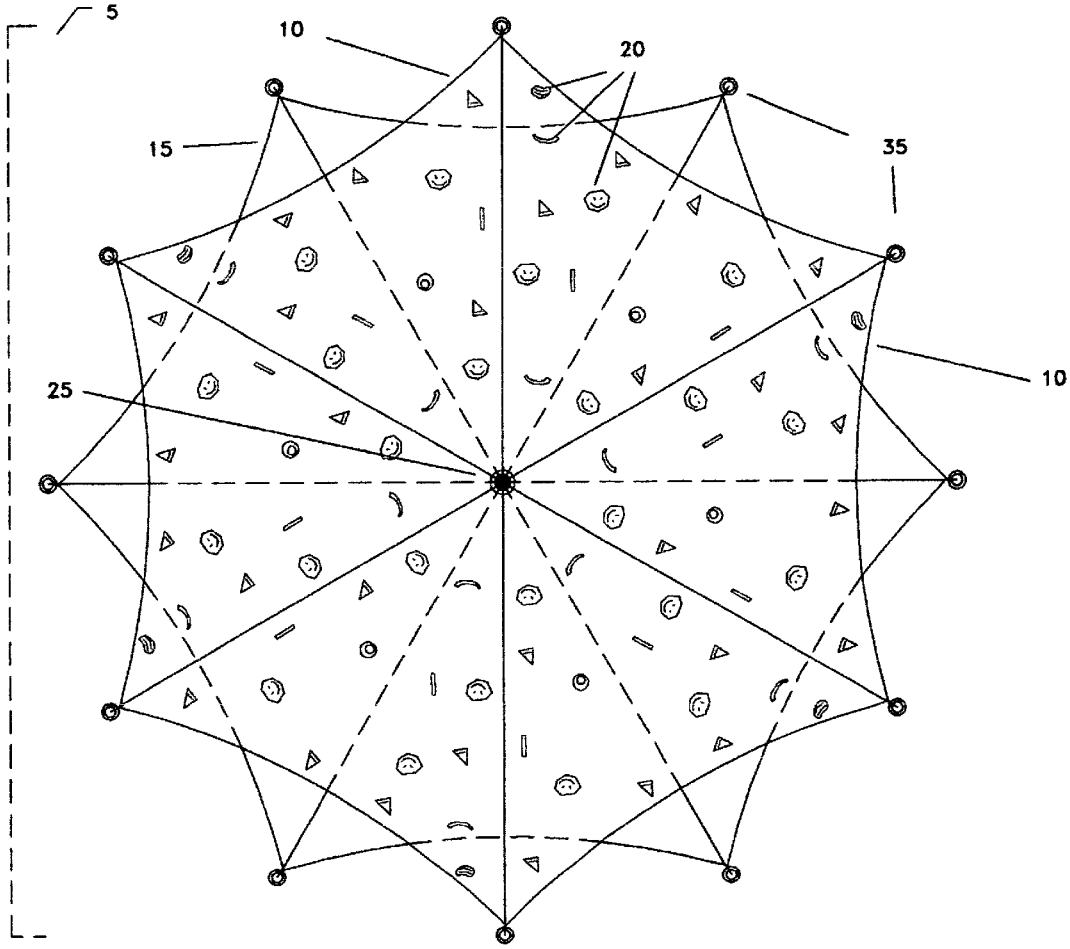
FIG. 3 is a top view of the ultra-light rock-climbing structure in its second embodiment showing support poles, a pliable climbing matrix, rock-climbing/gymnastic holds, ground anchors, and safety surfaces.

FIG. 3 is a top view of ultra-light rock-climbing structure 5 in its second embodiment. Pliable climbing matrix 10 is stretched over support pole 25 above the height at which safety surface 15 is stretched over a lower section of support pole 25. The perimeter edges of pliable climbing matrix 10 and safety surface 15 are attached in strong tension to multiple ground anchors 35 to form surfaces which can support the weight of climbers 45. Should climber 45 fall from any section of pliable climbing matrix 10, safety surface 15 will safely break the fall. Rock-climbing/gymnastic holds 20 can be attached anywhere on pliable climbing matrix 10, thereby allowing the spacing between holds to vary and the climbing routes to vary. Also, the particular shape and orientation of rock-climbing/gymnastic holds 20 add another dimension to the variability of a climbing route.

Figure 4:
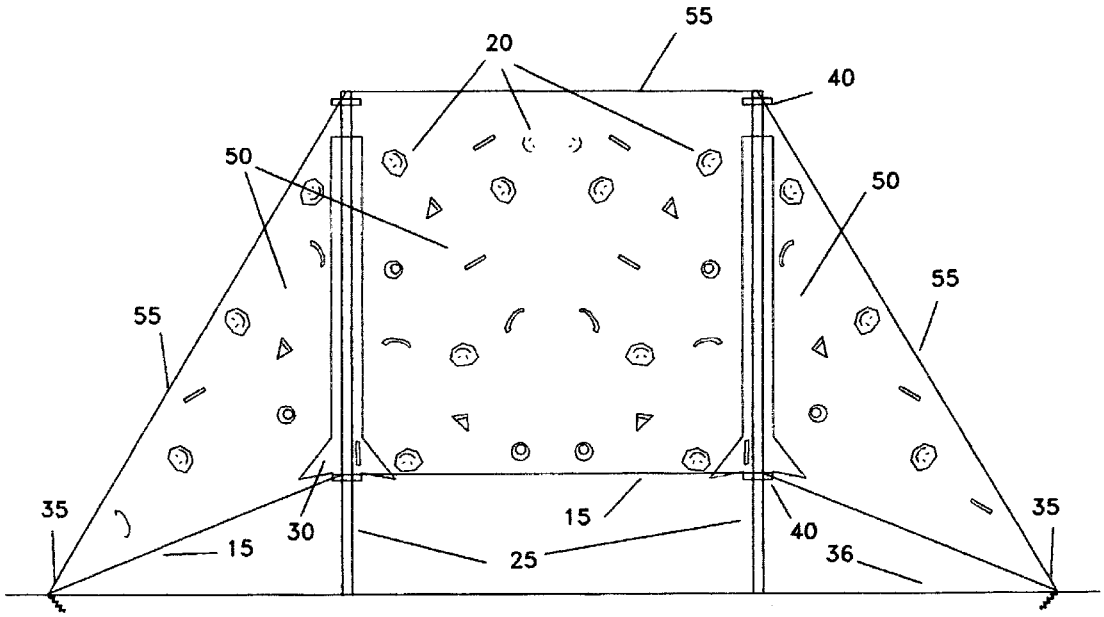
FIG. 4 is a front cross-sectional view of the ultra-light rock-climbing structure in its third embodiment showing a radial pliable climbing matrix hanging from a radial cable between a ground anchor and support poles.
Figure 5:
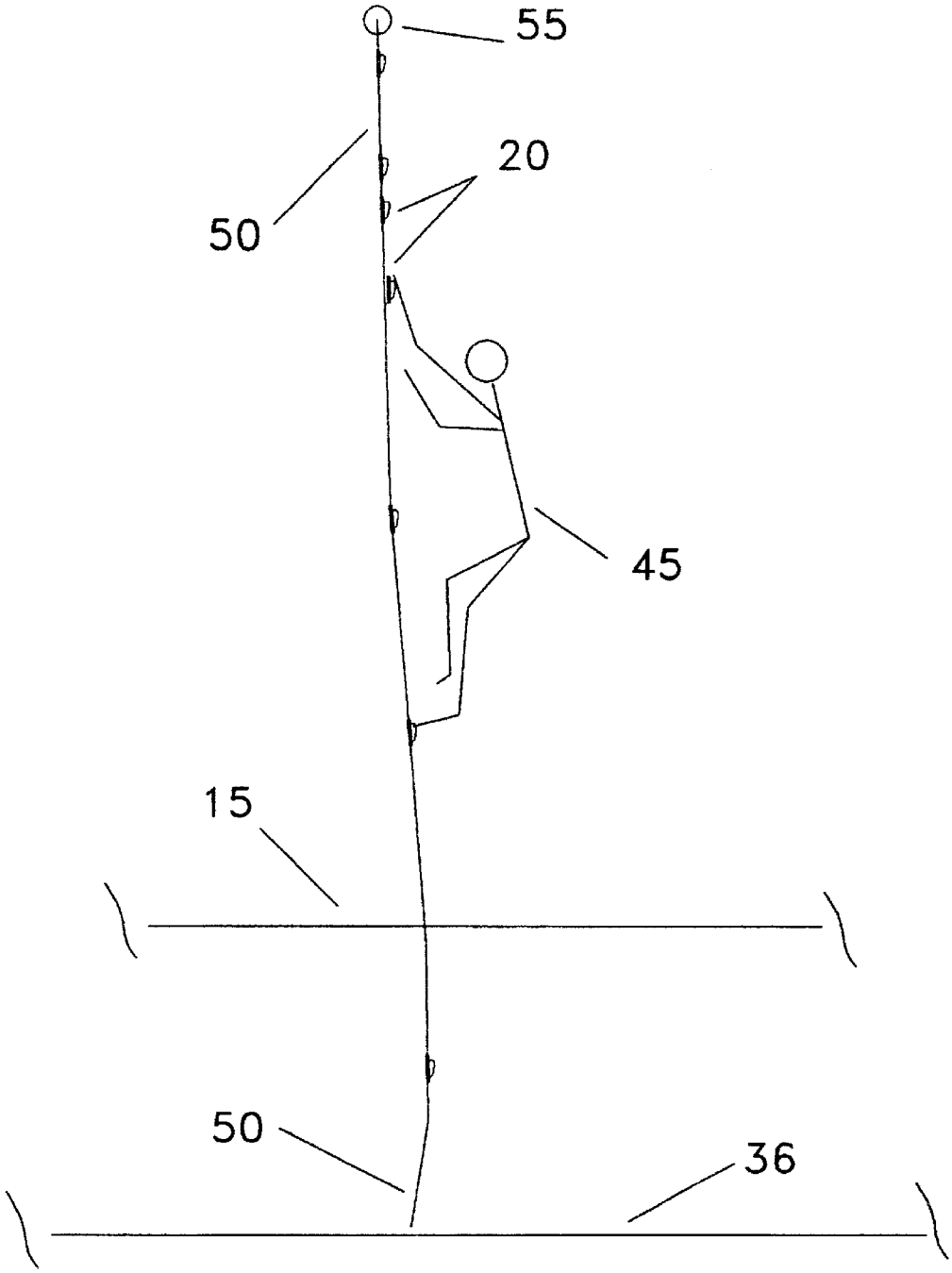
FIG. 5 is a side cross-sectional view of the ultra-light rock-climbing structure in its third embodiment showing a radial pliable climbing matrix hanging from a radial cable between a ground anchor and support poles.

FIG. 4 is a front cross-sectional view and FIG. 5 a side cross-sectional view of the ultra-light rock-climbing structure in its third embodiment showing radial pliable climbing matrix 50 hanging from radial cable 55 between ground anchors 35 and support poles 25. This embodiment demonstrates first that there may be multiple support poles 25. Second, it shows that a vertical or near vertical radial pliable climbing matrix 50 can be constructed by hanging it from radial cables 55. The less overhanging radial pliable climbing matrix 50 allows easier, less strenuous climbing. On the other hand, the advantage of the pliable climbing matrix 10 in FIGS. 2 and 3 is that it extends circumferentially around the support poles 25 in the center to create a larger climbing area.

Figure 6:
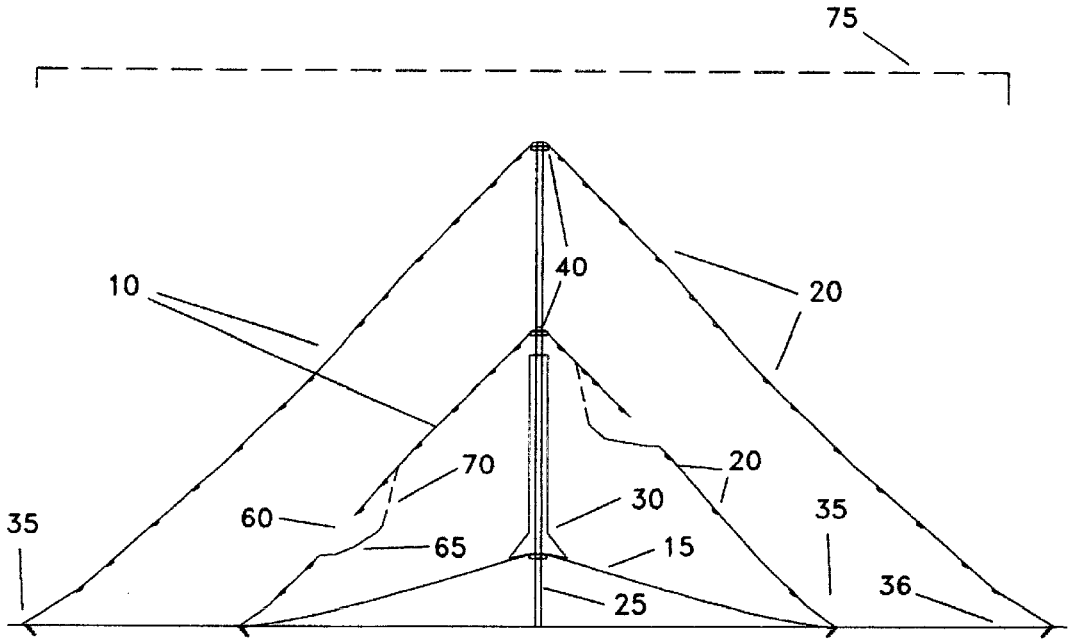
FIG. 6 is a cross-sectional side view of the ultra-light rock-climbing structure in its fourth embodiment showing multiple pliable climbing matrices and portals from one climbing region to another.

FIG. 6 is a cross-sectional side view of the ultra-light rock-climbing structure in its fourth embodiment showing multiple climbing-matrix structure 75. Support pole 25 now extends higher allowing a second pliable climbing matrix 10 to be added above the lower climbing structure 10, which now serves a second function as a safety surface 15 for the higher pliable climbing matrix 10. Portal hole 60 is made in the lower pliable climbing matrix 10 to allow climbers to move from the lower pliable climbing matrix 10 to the higher one. To prevent injury to a climber who may fall through portal hole 60 from the higher pliable climbing matrix 10, portal safety fold 65 is attached from the lower boundary of portal hole 60 to a higher region of pliable climbing matrix 10 via flap cable 70, shown with a dashed line.

Figure 7:
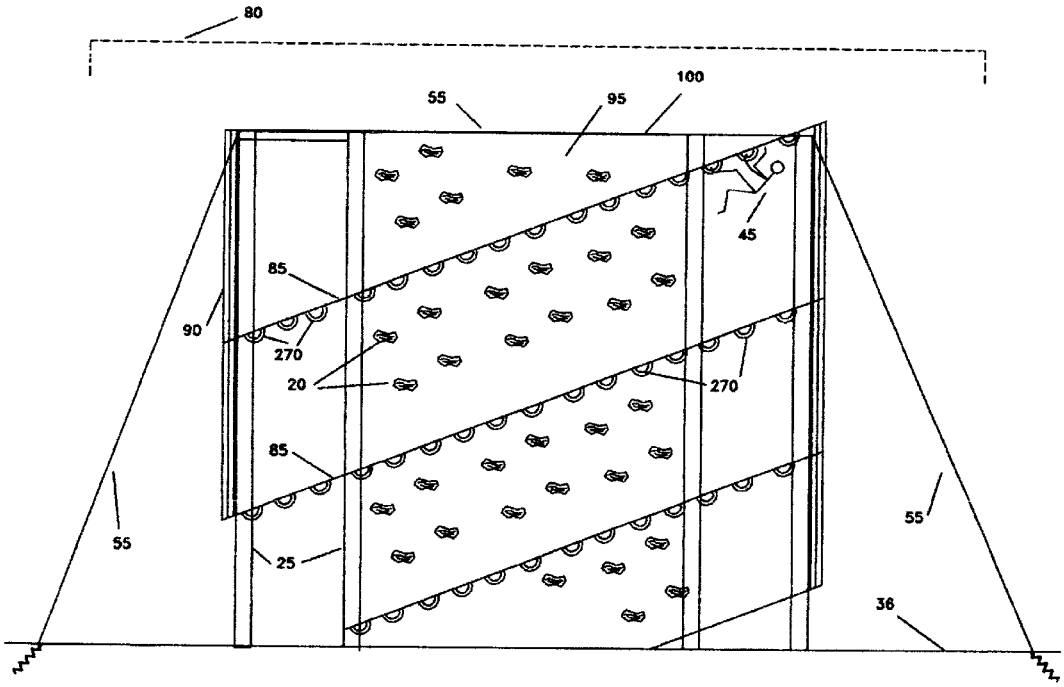
FIG. 7 is a front view of the ultra-light rock-climbing structure in its fifth embodiment showing a spiral configuration for continuous climbing.
Figure 8:
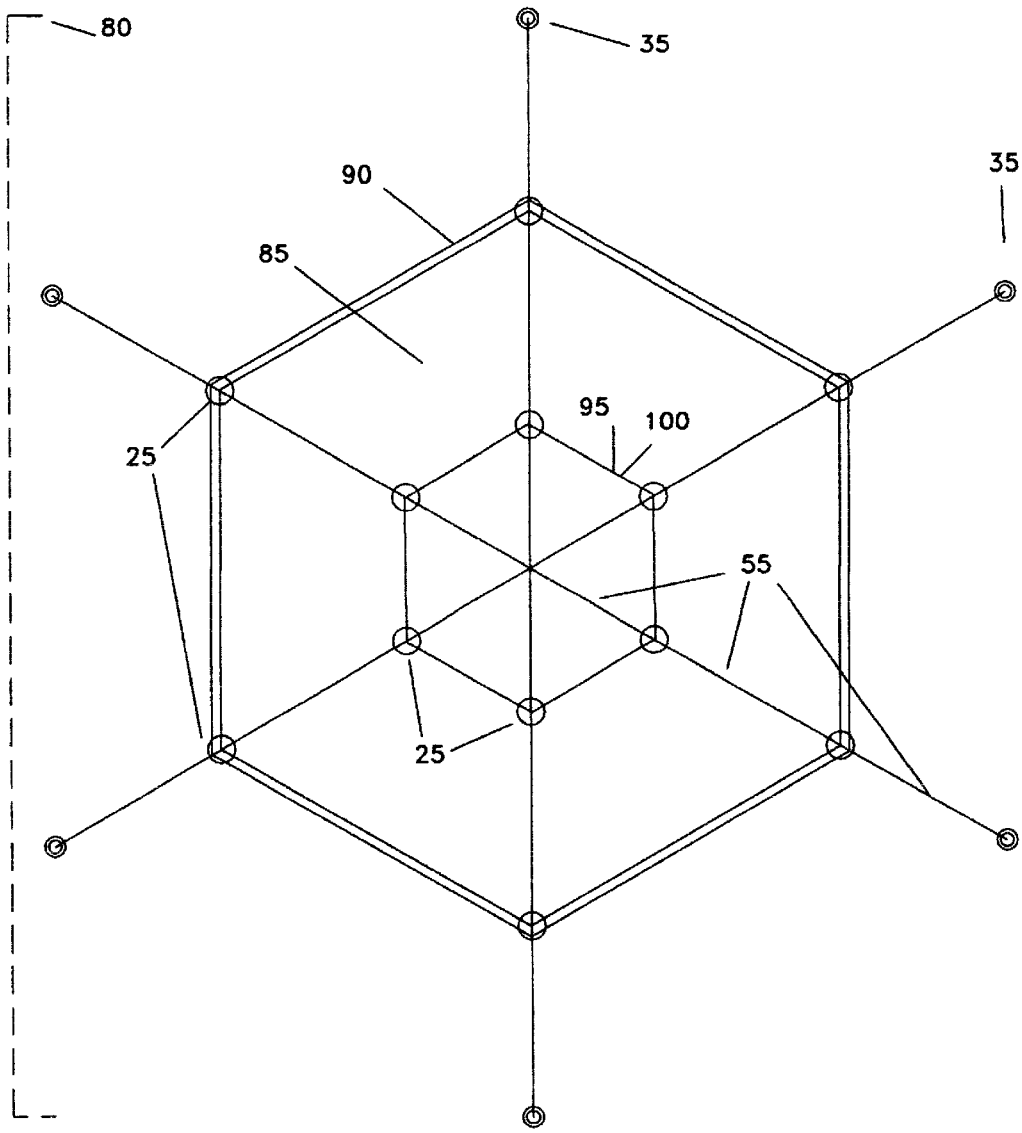
FIG. 8 is a top view of the ultra-light rock-climbing structure in its fifth embodiment showing a spiral configuration for continuous climbing.

FIG. 7 is a front view and FIG. 8 a top view of the ultra-light rock-climbing structure in its fifth embodiment showing spiral climbing structure 80. An inner set of support poles 25, which may consist of one center support pole 25 or multiple support poles 25, defines a polygon. Cables 100 both interconnect this inner set of support poles 25 and act as supports from which approximately vertical pliable climbing matrix 10 is hung. Note that both sides of this approximately vertical pliable climbing matrix 10 can be used for climbing. A second set of support poles 25 are located outside the first set to support spiral ramp pliable climbing matrix 85 which encircles and ascends the first set of support poles 25, spiraling upwards. Note that portions of spiral ramp pliable climbing matrix 85 serve as safety surfaces for other portions immediately above. Ramp safety restraints 90, which can be stiff netting, prevent a climber from falling to the ground off the outside of spiral climbing structure 80. Radial cables 55 support "support poles 25" via ground anchors 35. A climber can continuously climb (fi-om bottom to top) on the approximately vertical pliable climbing matrix 10 using rock-climbing/gymnastic holds 20, or on the overhanging spiral pliable climbing matrix 10 formed by spiral ramp pliable climbing matrix 85 using overhanging holds 270, or on both.

Figure 9:
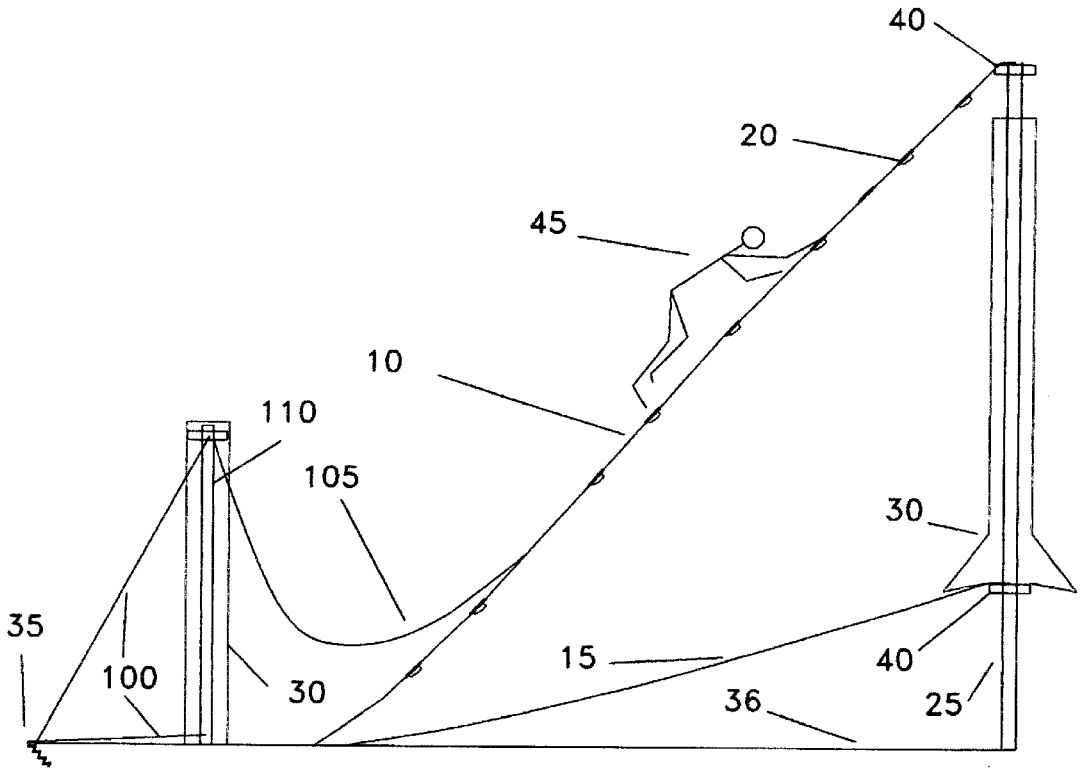
FIG. 9 is a side view of a edge safety flap to arrest a fall from the top side of the climbing matrix.

FIG. 9 is a side view of edge safety flap 105 which arrests a fall of climber 45 from the top side of pliable climbing matrix 10. Safety flap 105 is attached to a lower portion of pliable climbing matrix 10 and extends to flap pole 110, which is supported by ground anchor 35 via cables 100. Safety flap 105 can preferably be made of an elastic fabric or netting. Flap pole 110 is padded and can be made of a flexible material to yield a little by bending.

Figure 10:
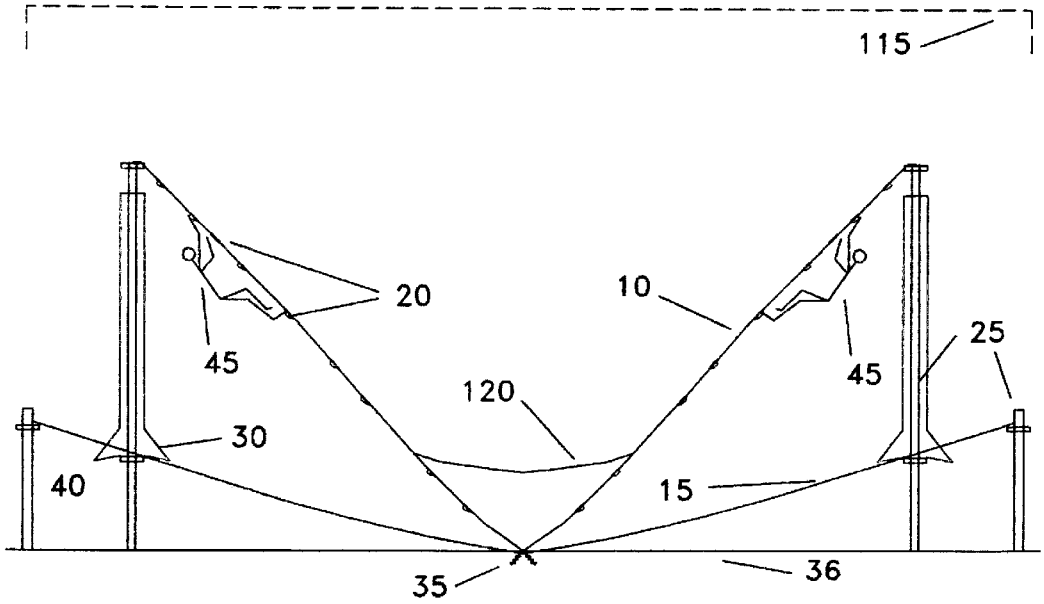
FIG. 10 is a cross-sectional side view of the ultra-light rock-climbing structure in its sixth embodiment showing a configuration with a ground anchor on the inside and support poles on the outside.

FIG. 10 is a cross-sectional side view of the ultra-light rock-climbing structure in its sixth embodiment showing a configuration called herein anchor-centric climbing structure 115. The general shape of this configuration is circular in a similar manner to the embodiment of FIG. 3, but now ground anchors 35 are at the center of the apparatus and support poles 25 are located around its perimeter. Additional support poles 25 are needed to extend safety surface 15 a sufficient distance beyond the extent of pliable climbing matrix 10 to ensure that any fall of climber 45 will be caught. The disadvantage of this embodiment is that more support poles 25 are needed. The advantages are that climbers 45 can be seen from outside the apparatus and the climbing area high above the ground is greater than in the second embodiment of FIG. 2. Center safety surface 120 is a circular, resilient fabric or net piece which is fixedly attached to pliable climbing matrix 10 around it perimeter and which will safely break a fall from the upper side of pliable climbing matrix 10.

Figure 11A:
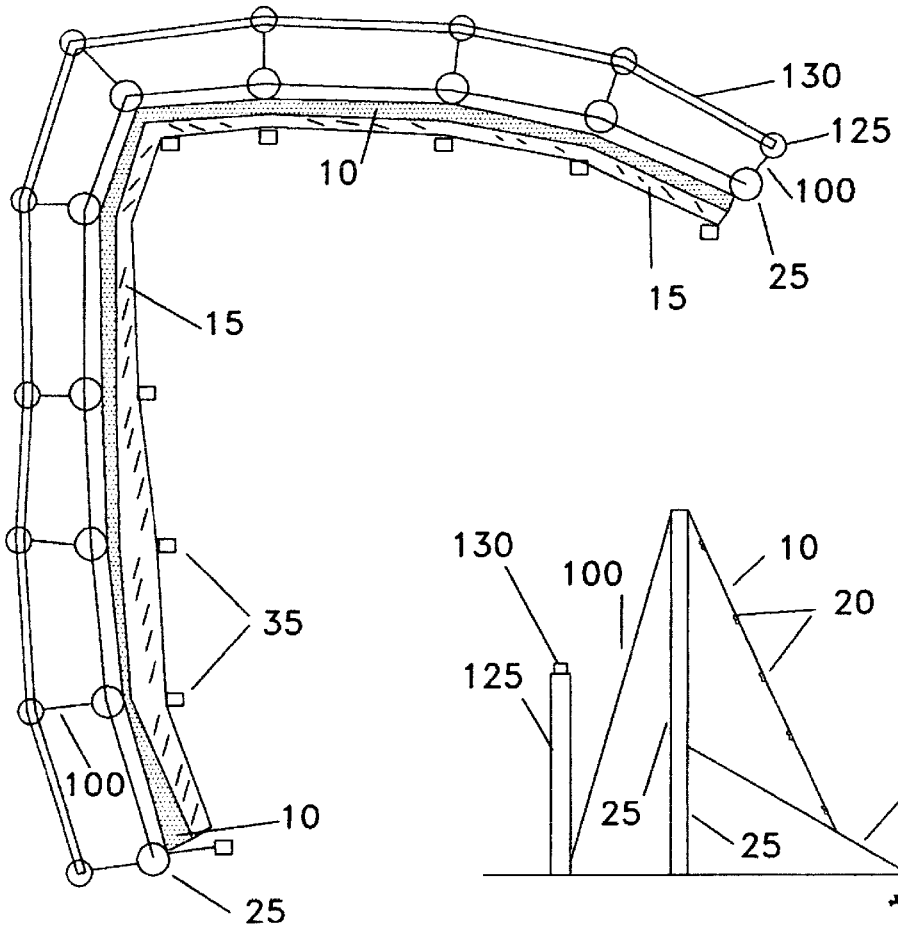
FIGS. 11*a* is a top view and 11*b* a side view of the ultra-light rock-climbing structure in its seventh embodiment where it follows a pre-existing fence.
Figure 11B:
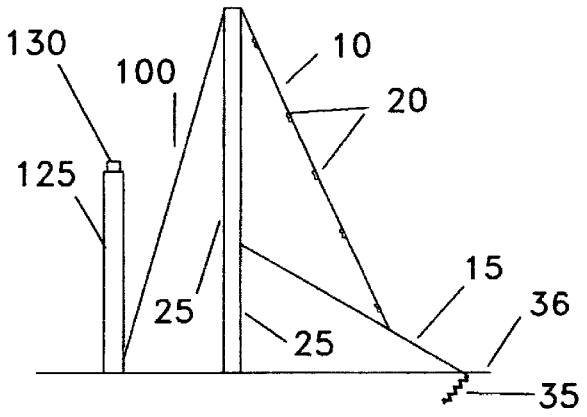
Figure 12:
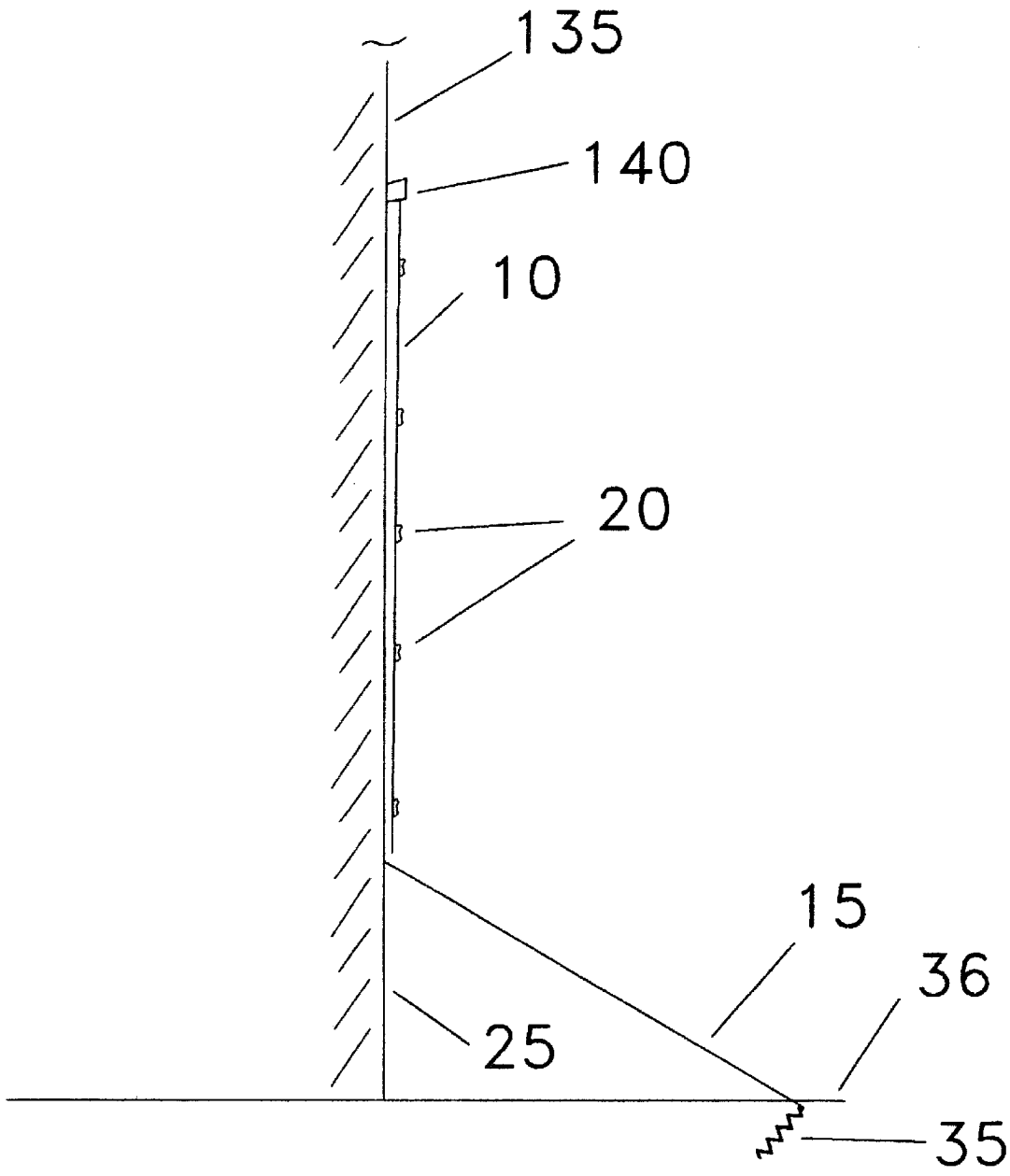
FIG. 12 is a side view of the ultra-light rock-climbing structure in its eighth embodiment where a pliable climbing matrix and a safety surface are mounted to a pre-existing wall via wall-attachment anchors.

FIG. 11*a* is a top view and FIG. 11*b* a side view of the ultra-light rock-climbing structure in its seventh embodiment where it follows a pre-existing fence. The fence comprises fence posts 125 and fence rails 130. Fence posts 125 act as an anchor via cables 100 for support poles 25 which support pliable climbing matrix 10 and safety surface 15 in tension with ground anchors 35. Pliable climbing matrix 10 actually attaches to a lower portion of safety surface 15 in this case; this is a variation that can apply to any of the embodiments of this invention. In a similar fashion, a high pre-existing fence or wall can be used in place of support poles 25—in which case safety surfaces 15 and pliable climbing matrices 10 are attached to a high section of that wall or fence and are supported in tension with ground anchors 35. One variation of this is shown in FIG. 12, a side view of the ultra-light rock-climbing structure in its eighth embodiment where pliable climbing matrix 10 and safety surface 15 are mounted to pre-existing wall 135 via wall-attachment anchors 140. Advantages of this embodiment are that a very solid wall can be used to circumvent all the structural difficulties of making a climbing wall, and that draping or hanging a pliable climbing matrix 10 over that wall eliminates the need to put bolts, nails or screws in that wall for each climbing hold. Thus, the wall does not have to be disfigured. Also, the climbing route can be assembled on the ground by attaching rock-climbing/gymnastic holds 20 to pliable climbing matrix 10, thereby eliminating the need to place each hold from a ladder. Another recourse is to tack, glue, or tape parts of pliable climbing matrix 10 to pre-existing wall 135 to prevent it from pulling away from pre-existing wall 135. Yet another option, when the wall surface is smooth, is to use suction clips on the base of climbing hold 20 to attach them to the pre-existing wall 135. In the event that the suction hold might fail, the fact that the climbing hold 20 is also attached to a pliable climbing matrix 10 means that climber would only slip a few inches. Just as with the embodiment of FIG. 11 which is extended as it follows a fence, the various other embodiments discussed herein can be extended in area and shape.

Figure 13:
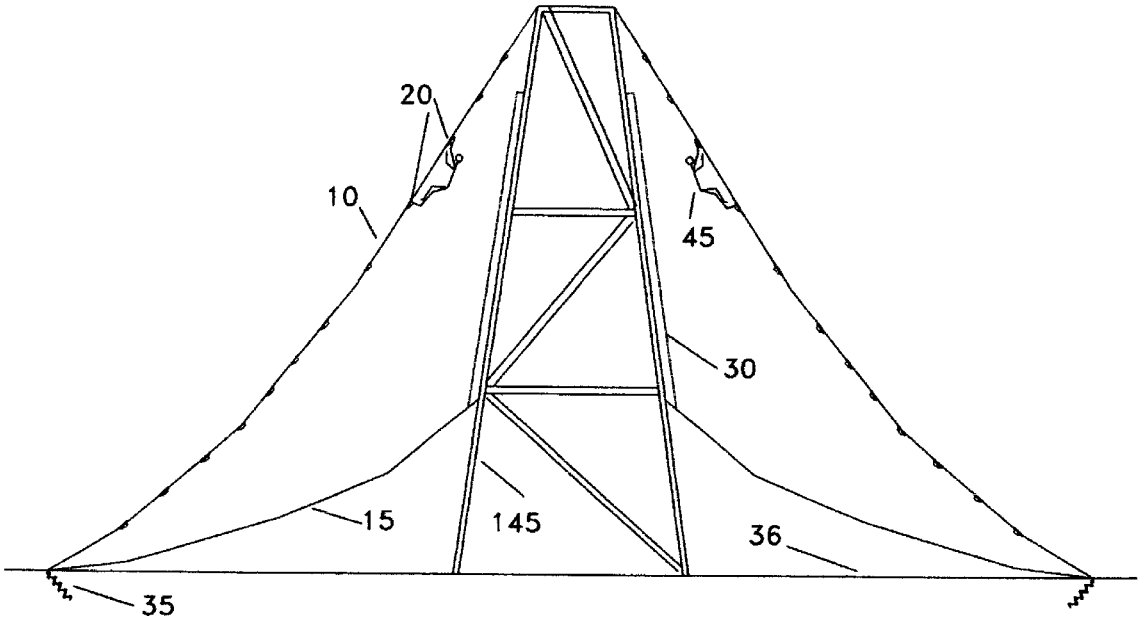
FIG. 13 shows a space-truss version of the elevated structure instead of support poles.

FIG. 13 shows, in place of support poles, a space-truss version of the elevated structure—mentioned in the discussion of FIG. 2 as one of the primary elements of the second embodiment of the invention. Space-truss 145 replaces support pole 25 of FIG. 2. Alternatively, a tree or a pre-existing pole or column can be used to replace support pole 25.

Figure 14:
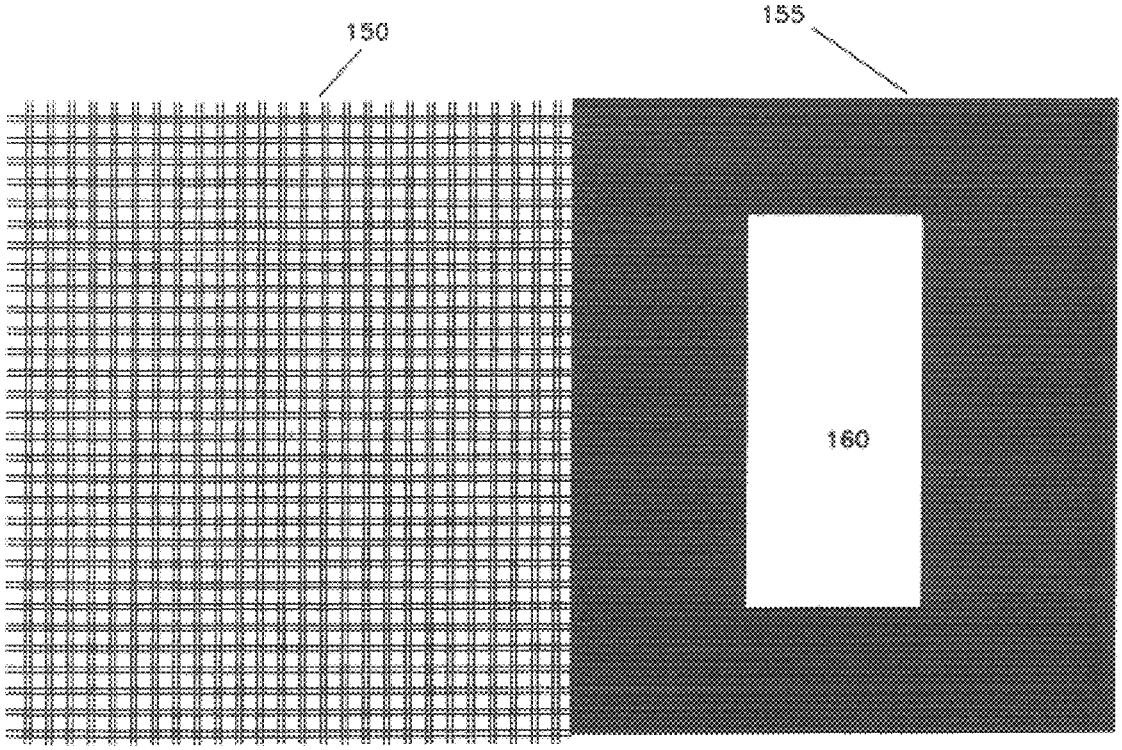
FIG. 14 shows various types of material used for a pliable climbing matrix.
Figure 15:
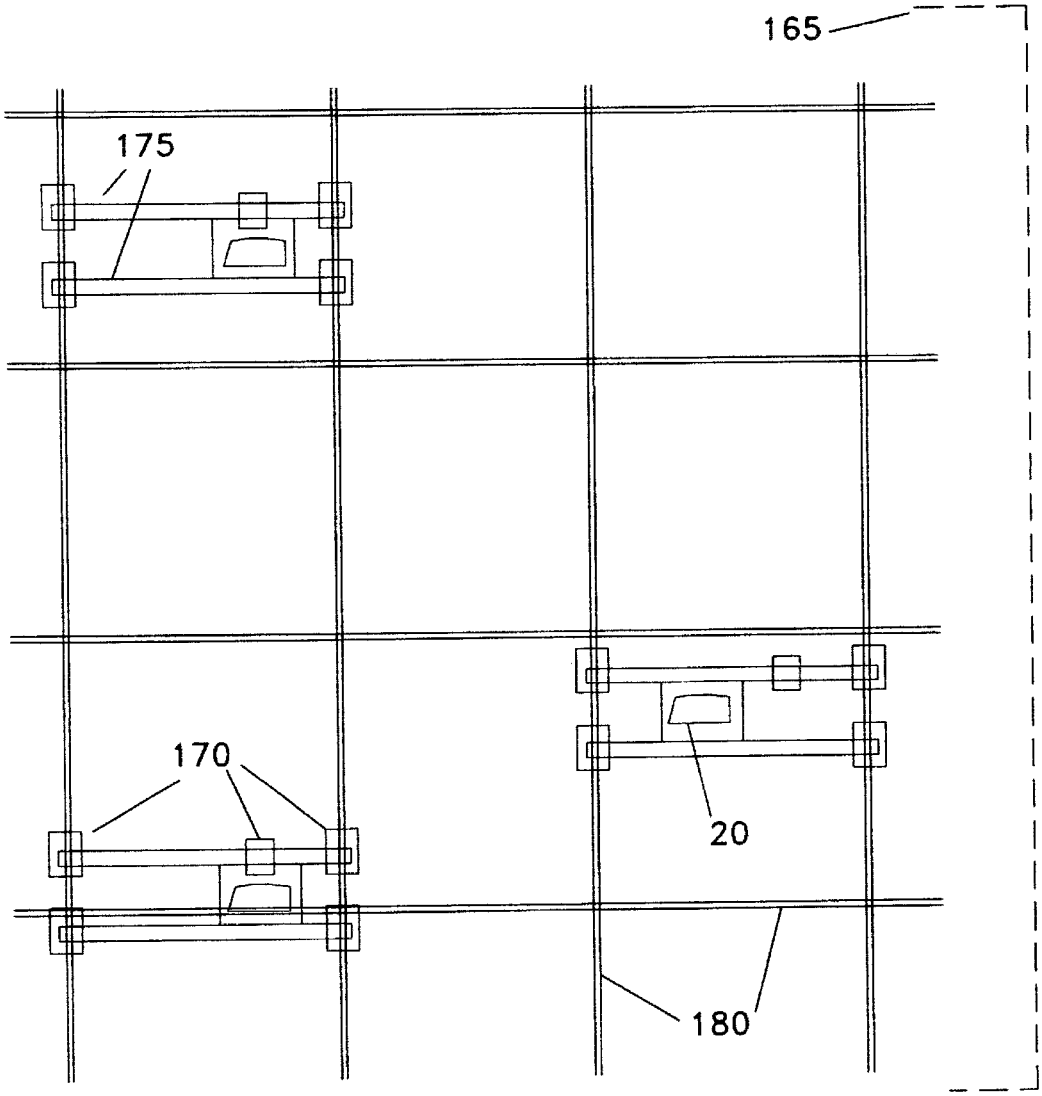
FIG. 15 shows a minimal cord lacework for a pliable climbing matrix and a means to attach rock-climbing/gymnastic holds to the same.

FIG. 14 shows various types of material used for a pliable climbing matrix or safety surface. The key innovation of the invention is to reduce the bulk of the prior art "heavy panel" climbing matrix by using a lightweight pliable climbing matrix which is easy to fold or roll up. In effect, this innovation represents an minimization of weight and bulk by minimizing the interconnections between the rock-climbing/ gymnastic holds. The requirement that the pliable climbing matrix be pliable or rollable limits the material to fabric, netting, or thin and flexible synthetic sheets of material such as fiberglass. Netting 150 in FIG. 14 offers the advantage of less bulk, and it eliminates the need for special holes for attaching rock-climbing/gymnastic holds. Mesh material can also be used, and the void spaces between the netting material can be of variable size. Solid fabric 155 is another possibility, and fabric holes 160 can be incorporated to reduce material bulk. The larger the void spacing between netting 150, the less bulky is the material, but at some point the strength of the material is compromised, and the positionability of the rock-climbing/gymnastic holds is compromised. Also, at some point as the material becomes more sparse, it makes sense to use a lacework of cables or cords. FIG. 15 shows minimal cord lacework 165 for a pliable climbing matrix and a means to attach rock-climbing/gymnastic holds 20 to the same. In this design the challenge is to attach rock-climbing/gymnastic holds 20 so that they are positionable and stable. Hold extensions 175 are fixedly attached to rock-climbing/gymnastic holds 20 and to the vertical cords 180 with clamps 170. The position of climbing hold 20 can be moved, first, by clamping hold extensions 175 at variable positions along the vertical cords 180 and, second, by clamping rock-climbing/gymnastic holds 20 at various positions along hold extensions 175.

Figure 16:
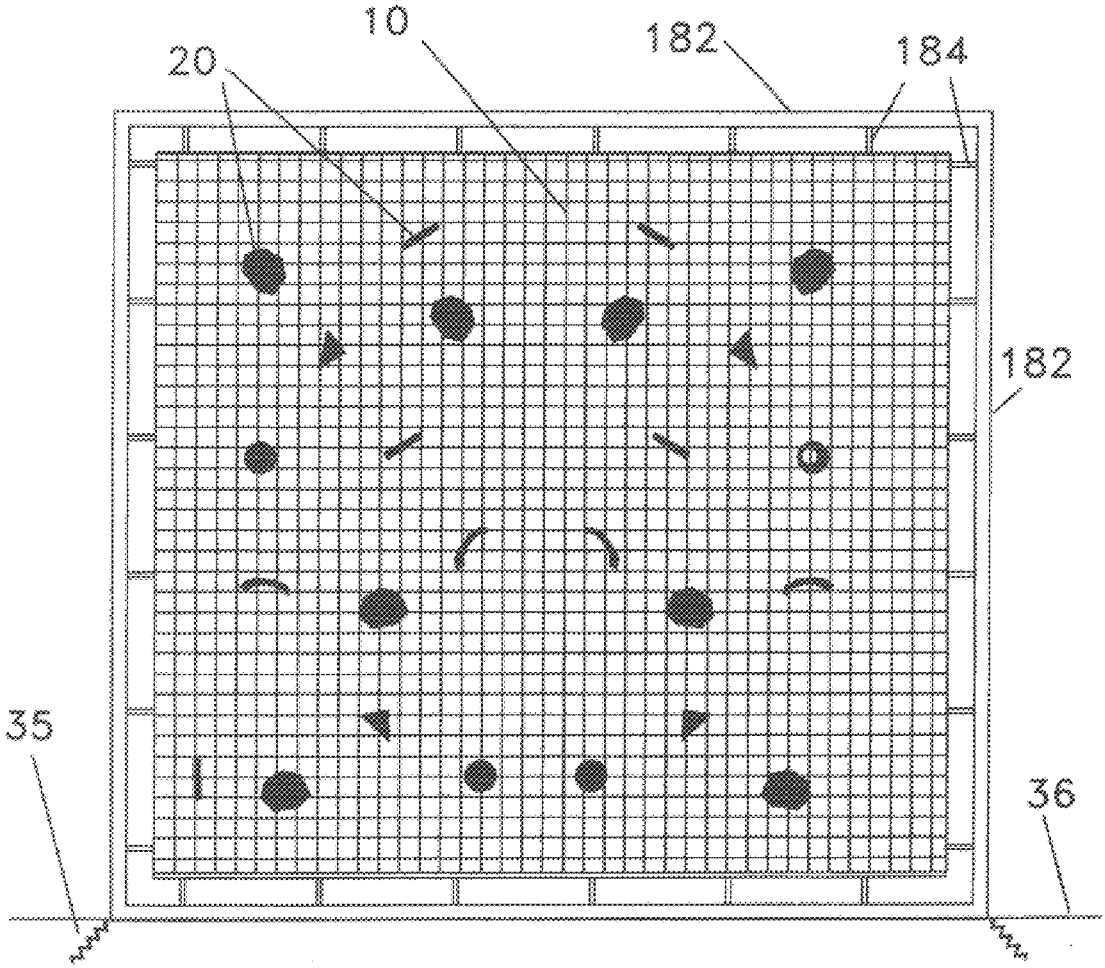
FIG. 16 shows a rigid skeletal infrastructure for a pliable climbing matrix.

FIG. 16 shows rigid skeletal infrastructure 182 which can be attached to pliable climbing matrix 10 via tension cords 184. That is, climbing matrix 10 is pulled taut like a drum skin to reduce sag (give) due to a climber's weight. There are any number of ways to make such an infrastructure. One example is to use a "tent-frame" element where adjacent hollow tubes are fit, one within the next for easy assembly.

Figure 17:
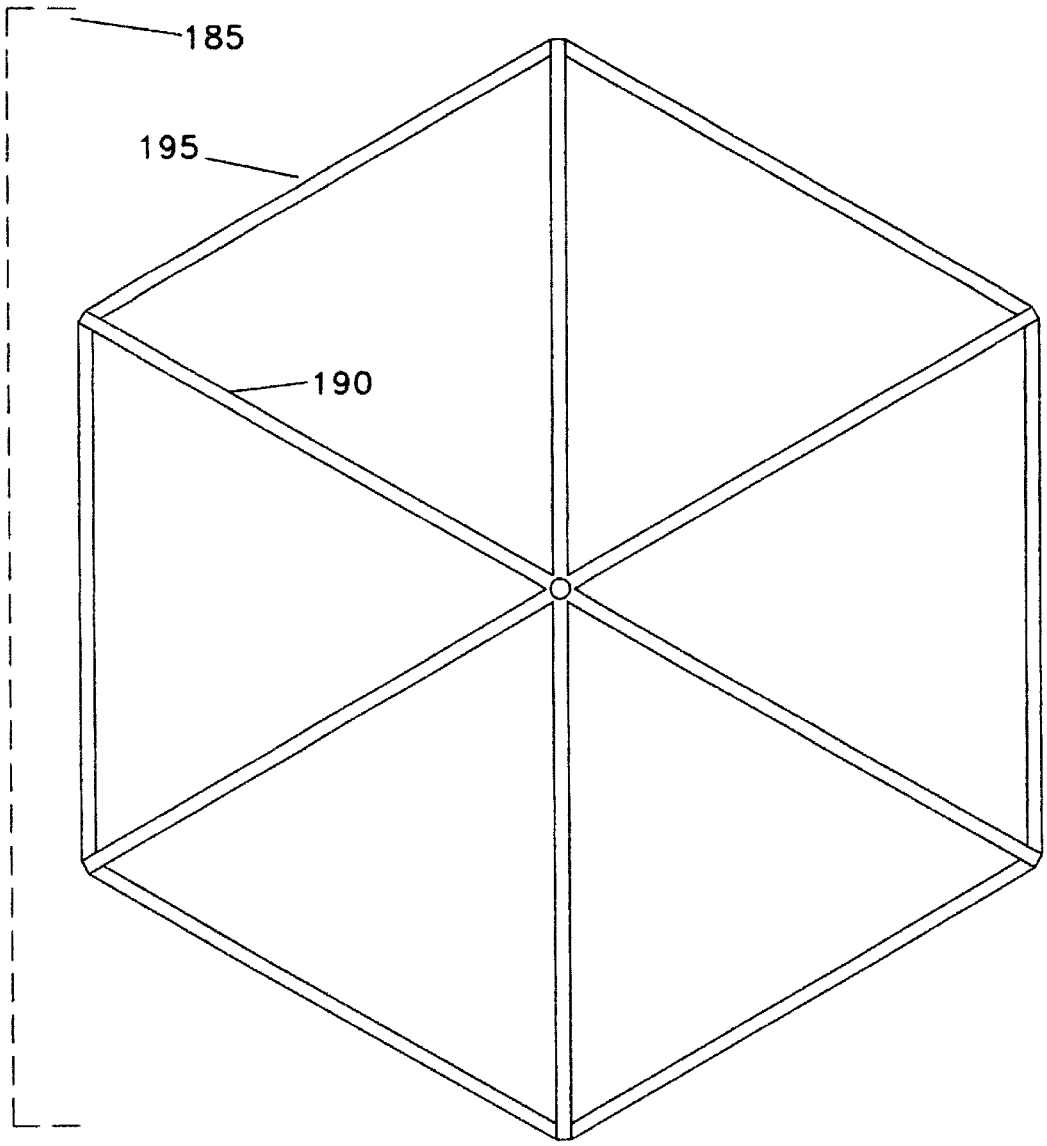
FIG. 17 shows top view of a portable ground framework.

FIG. 17 shows a top view of portable ground framework 185 which can be used where ground anchors cannot be used (e.g., in a building). Portable ground framework 185 lies on the ground and comprises radial elements 190 and perimeter elements 195 which are interconnected to allow safety surfaces 15 and pliable climbing matrices 20 of FIG. 2 to be supported in tension between perimeter elements 195 and support pole 25.

Figure 18:
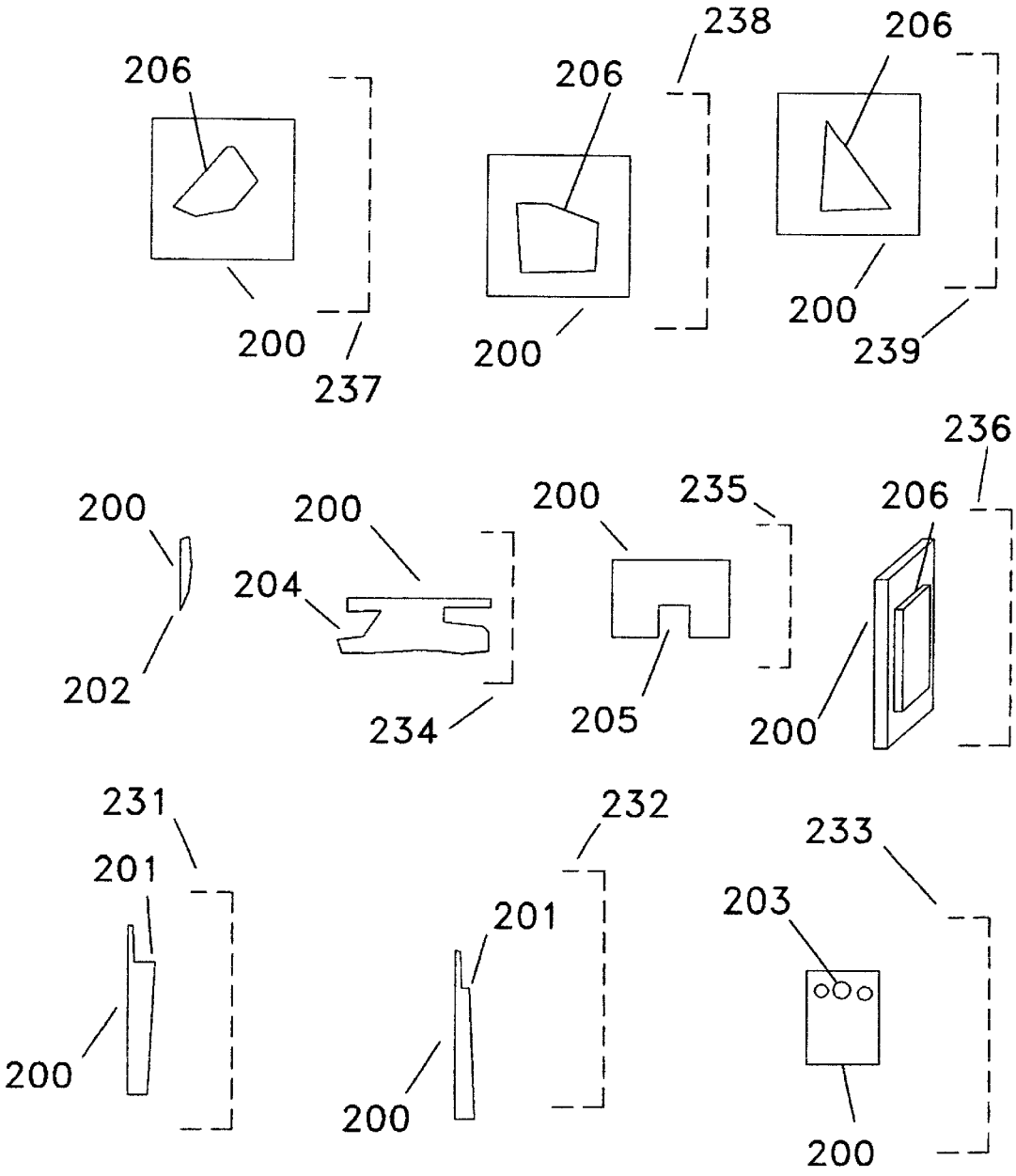
FIG. 18 shows a variety of rock-climbing holds which can be used to vary a climbing route.

FIG. 18 is shows a variety of rock-climbing holds 20 which can be used to vary a climbing route and make it interesting and challenging. Each hold comprises hold base 200, directly attached and in contact with pliable climbing matrix 10, a one of several types of support features which are grasped or used for purchase or friction by the fingers, hands, or feet of climber 45. These support features include hold edge 201, jib hold 202, hold hole 203, hold lip 204, hold crack 205, and hold boss 206. Hold-A 231 shows hold edge 201 oriented horizontally; hold-B 232 shows a smaller example of hold edge 201 oriented horizontally, hold-C 233 shows hold holes 203; jib hold 202 shows a small feature which can be used for a very small amount of support; hold-D 234 shows hold lip 204; hold-E 235 shows hold crack 205; hold-F 236 shows in perspective hold boss 206; hold-G 237 shows another shape of hold boss 206; hold-H 238 shows another shape of hold boss 206; and hold-G 237 shows another shape of hold boss 206.

Figure 19:
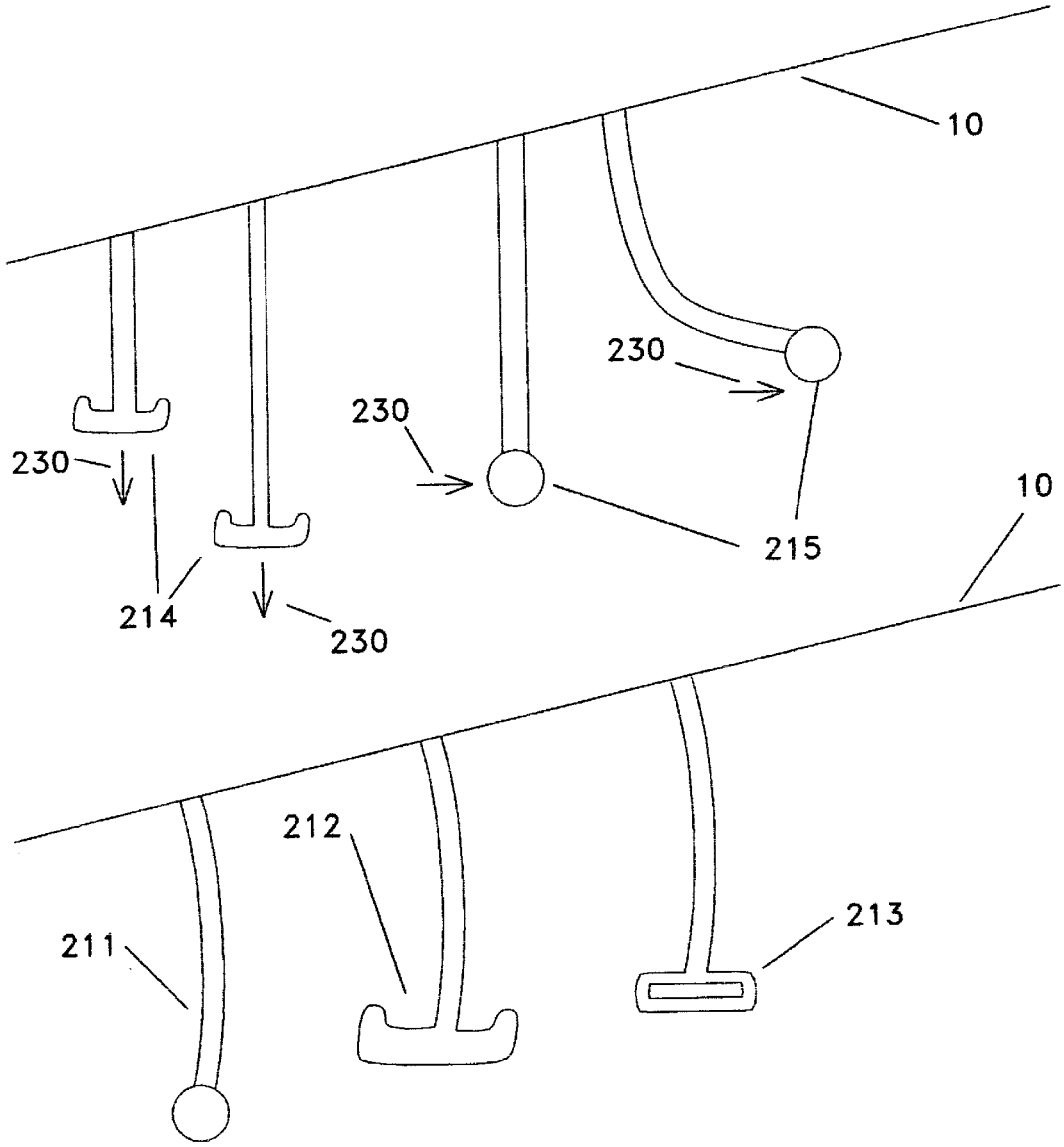
FIG. 19 shows a variety of novel gymnastic holds which can be used to vary a climbing route.
Figure 20:
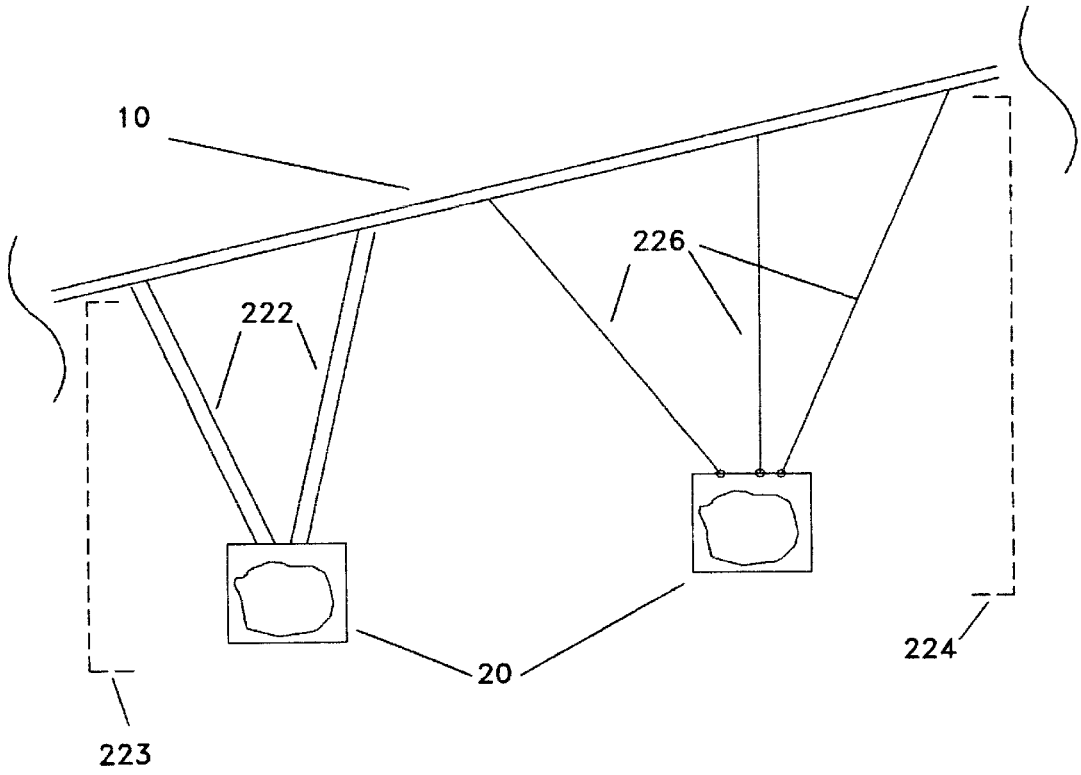
FIG. 20 shows suspension climbing holds.

FIG. 19 shows a variety of novel gymnastic holds attached to pliable climbing matrix 10, including swinging rope hold 211, swinging lip hold 212, and swinging handle hold 213. Elastic hold 214 is shown in its un-stretched and stretched positions where arrow 230 indicates the stretching force. Bending spring hold 215 is shown in its unbent and bent positions where arrow 230 indicates the bending force. FIG. 20 shows suspension climbing holds attached to pliable climbing matrix 10. Rigidly suspended hold 223 is fixed in space with rigid suspension elements 222 while suspended-in-tension hold 224 is fixed in space with suspension cables 226. This idea of suspension holds is novel, and can be claimed independently of the ultra-light rock-climbing wall invention. Furthermore, it allows construction of three-dimensional climbing routes that range from short routes to extensive routes. The challenge is to do this is such a way that the a climber will not be injured by falling on the support elements of the suspension holds.

Figure 21A:
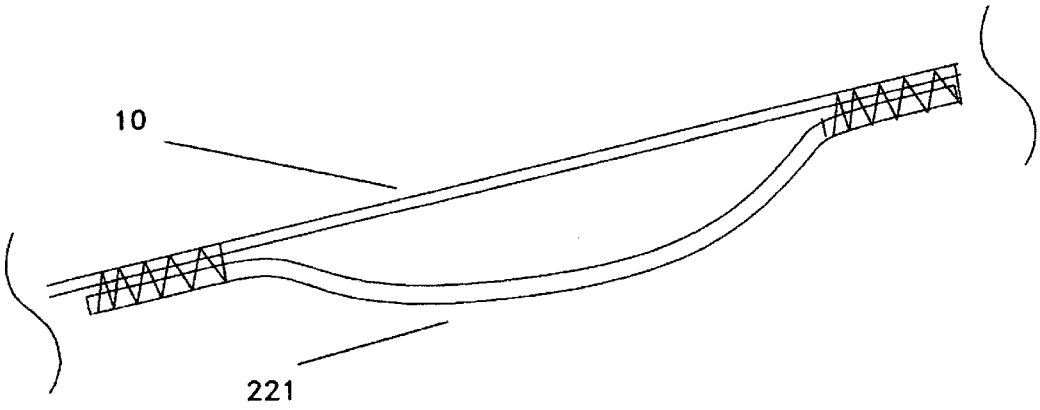
FIGS. 21*a* shows sewn loop and 21*b* shows hold-base clamp a for attaching rock-climbing/gymnastic holds to a fabric, mesh, or net pliable climbing matrix.
Figure 21B:
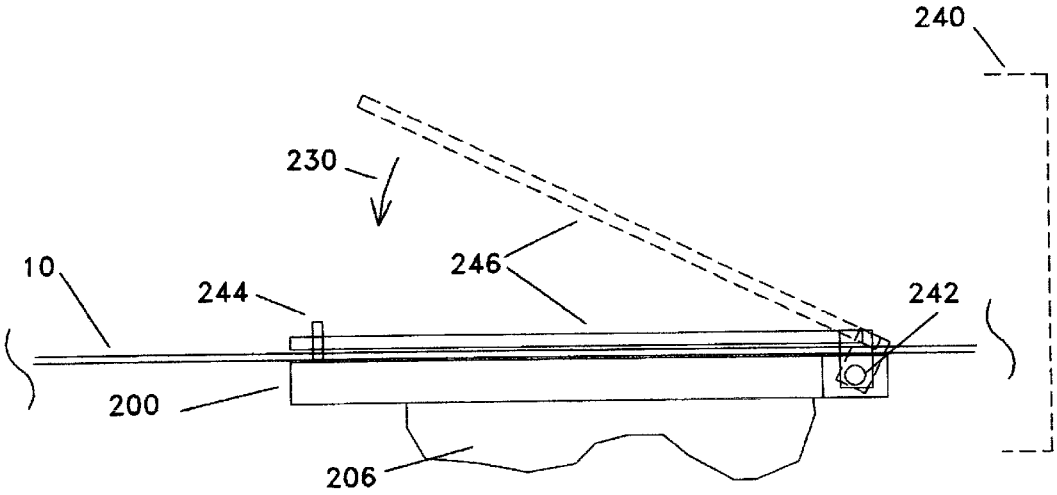

FIG. 21 shows means for attaching rock-climbing/gymnastic holds to a fabric or net pliable climbing matrix 10. FIG. 21*a* shows sewn loop 221 sewn to pliable climbing matrix 10 in such a way that a climber can grasp sewn loop 221 for support. FIG. 21*b* shows hold-base clamp 240 comprising base pivot 242, base catch 244, hold base 200, clasp rod 246, and hold boss 206. Both base catch 244 and clasp rod 246 are sufficiently small in circumference to poke or pass through pliable climbing matrix 10, in the case where it is made of a loosely woven fabric, a mesh or a net. Alternatively, holes can be incorporated in pliable climbing matrix 10 should it be made of a solid material or a tightly woven fabric—e.g., these holes could be made with grommets. To attach hold-base clamp 240 to pliable climbing matrix 10, clasp rod 246 is rotated away from base catch 244 (as indicated by its dashed version) and pushed through pliable climbing matrix 10 along with base catch 244. Then clasp rod 246 is closed and latched into base catch 244. There may be one or more of base catch 244 on a hold base 200 on a particular hold. One distinct advantage of this design is that a number of vertical strands, of netting or loosely woven fabric, can be fixedly engaged by ensuring sufficient contact pressure between base catch 244 and clasp rod 246. The advantage of positional holds is that rock-climbing/gymnastic holds 20 can then be moved to adapt a climbing route to climber size and to vary its difficulty.

It should be understood that there are other ways and methods, obvious to one of ordinary skill in the fabric-fabrication art, to attach objects or holds to a fabric or netting material. These other methods do not depart from the device intent here to make a strong and durable attachment of rock-climbing/gymnastic holds to a pliable surface.

Figure 22:
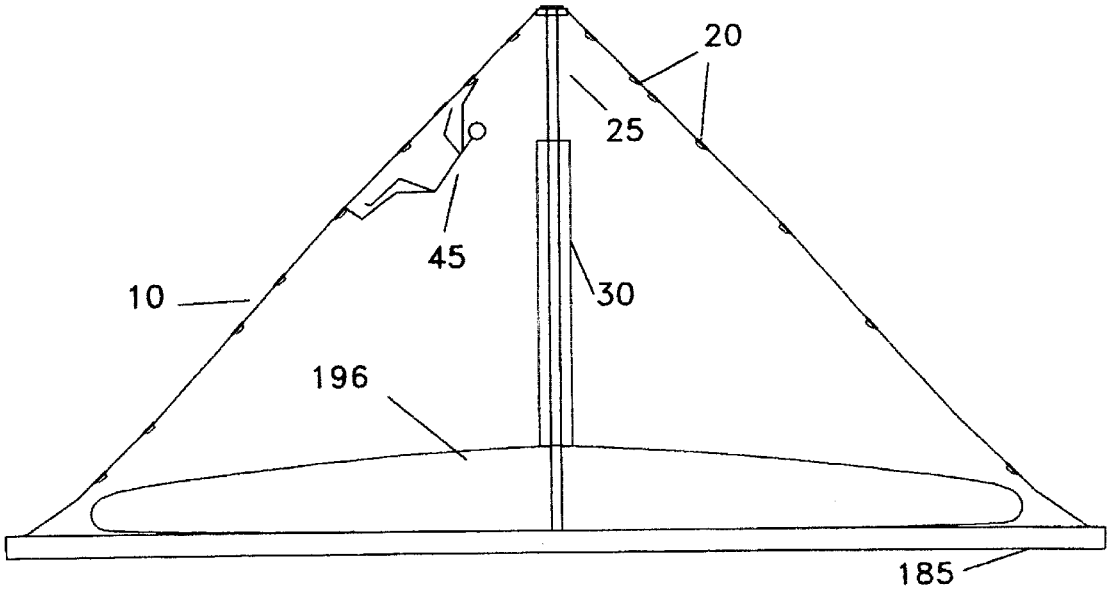
FIG. 22 shows an inflatable base which can serve the purpose of a safety surface.

FIG. 22 shows inflatable base 196 which functions both as a safety surface and as a flotation means. If inflatable base 196 is used as a flotation apparatus, portable ground framework 185 from FIG. 17 must be incorporated to allow safety surface 10 to support pole 25 in tension.

Figure 23:
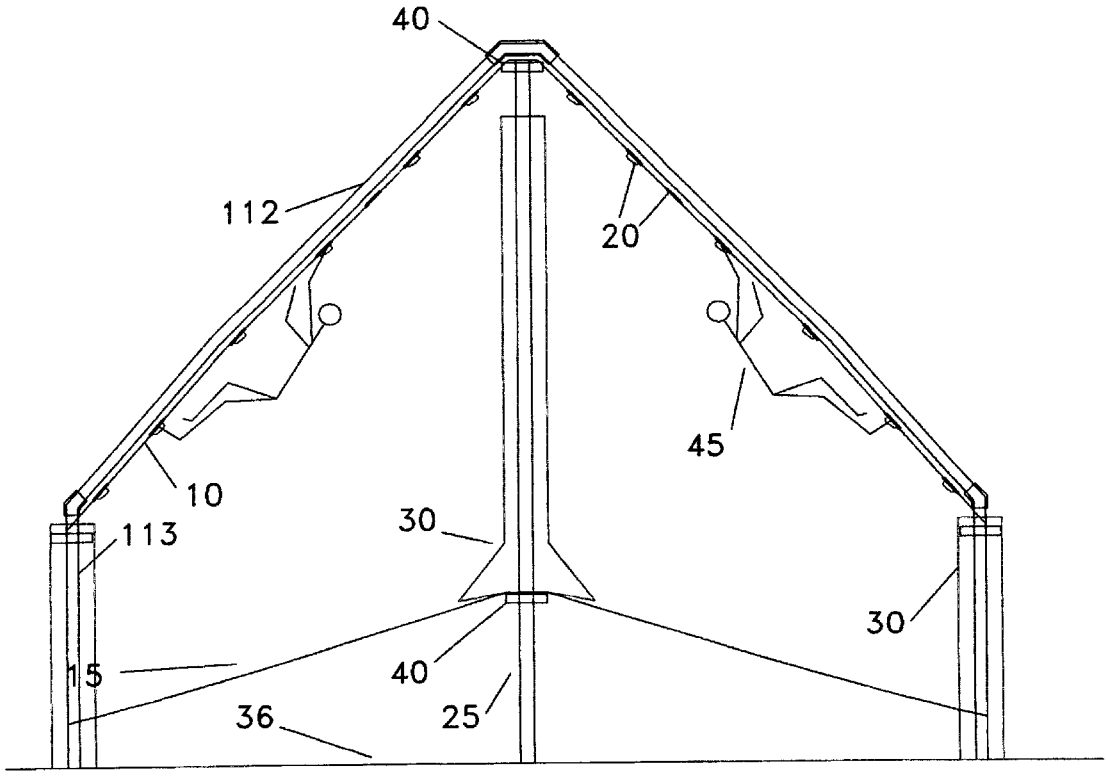
FIG. 23 is a side cross-sectional view of the ultra-light rock-climbing structure in its ninth embodiment where a pliable climbing matrix is stretched over an infrastructure comprising infrastructure trusses.

FIG. 23 is a side cross-sectional view of the ultra-light rock-climbing structure in its ninth embodiment where pliable climbing matrix 10 is stretched over an infrastructure comprising infrastructure trusses 112 and infrastructure posts 113. In this example, infrastructure posts 113 are located on the perimeter of the apparatus and can be connected by fence railing around the perimeter. Pliable climbing matrix 10 is still very lightweight. Infrastructure trusses 112 eliminate the need for ground anchors and reduce the amount of sag in pliable climbing matrix 10, but add to the overall weight and cost of the apparatus.

Figure 24:
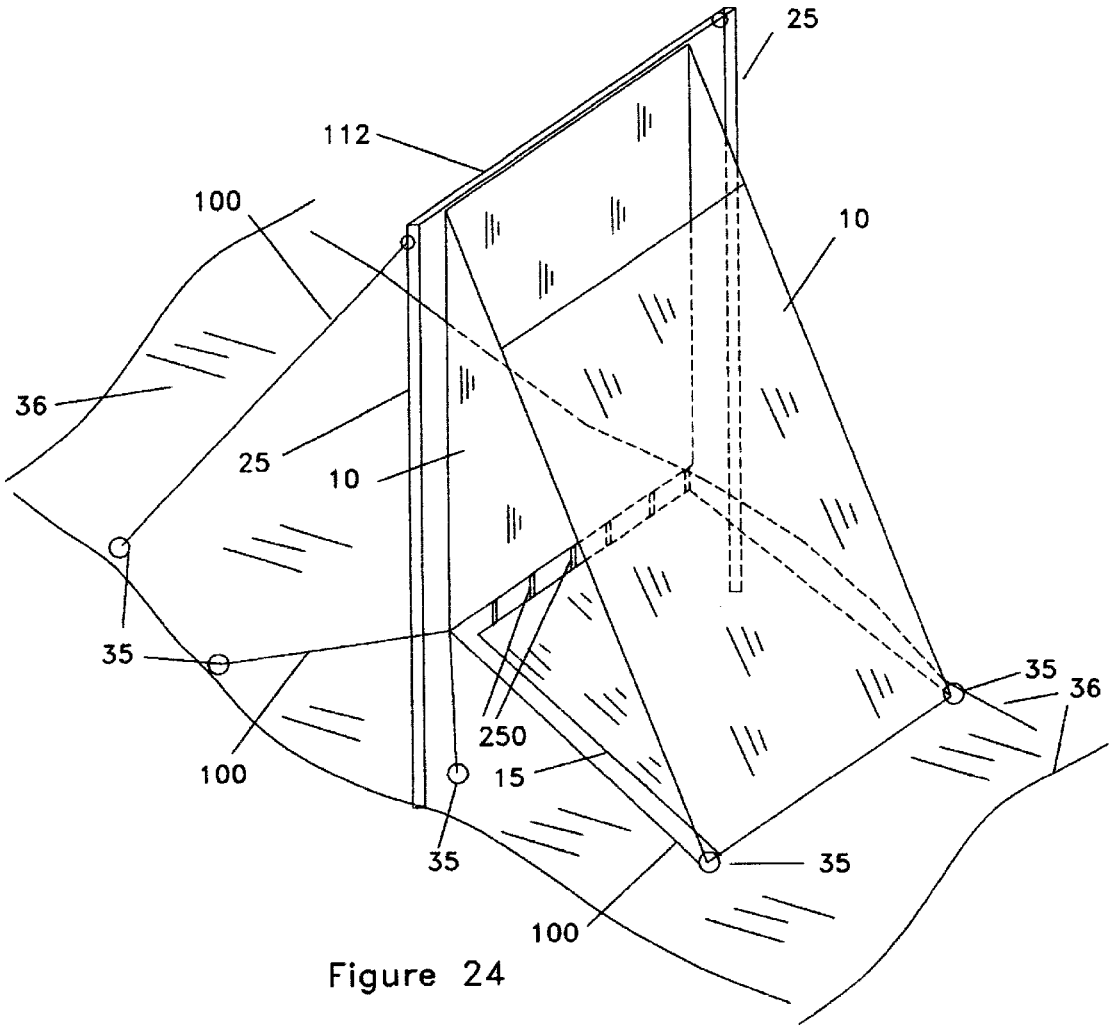
FIG. 24 is a perspective view of the ultra-light rock-climbing structure in its tenth embodiment showing a combination of vertical and overhanging climbing matrices.

FIG. 24 is a perspective view of the ultra-light rock-climbing structure in its tenth embodiment showing a combination of vertical and overhanging climbing matrices 10. A vertical climbing matrix 10 hangs from infrastructure truss 112 between two support poles 25. An overhanging climbing matrix 10 hangs from infrastructure truss 112 between two support poles 25, and it is held taut down to ground anchors 35 at the level of ground 36. Cables 100 support in tension support poles 25 and the bottom border of the vertical climbing matrix 10. Safety surface 15 is stretchably attached to the bottom border of the vertical climbing matrix 10 by safety springs 250—so that any fall of a climber from either climbing matrix 10 will be safely arrested by safety surface 15, which yields adequately as safety springs 250 are stretched by the force of the fall. Note first, that climbing holds 20 are not shown to make it easier to distinguish the vertical and overhanging climbing matrices 10, but they would actually be distributed over one or both sides of climbing matrices 10. Note second, that the top portion of the overhanging climbing matrix 10 is open (a void) to allow a climber to climb to the top of the vertical climbing matrix 10 without hitting his head on the overhanging matrix 10. This figure simply demonstrates that vertical and overhanging climbing matrices 10 can be incorporated in the invention, and this can be done in any of a large number of configurations.

Figure 25:
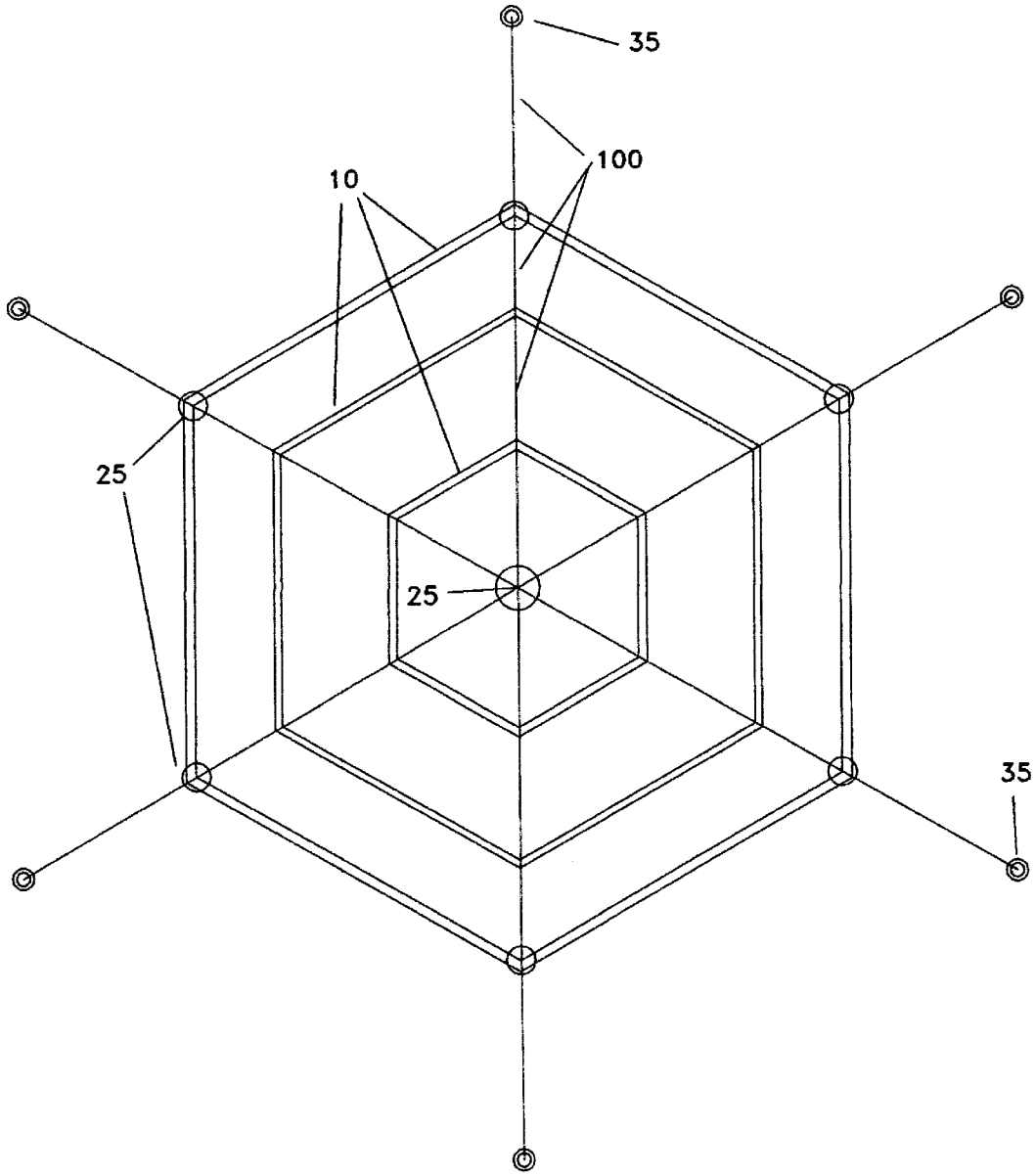
FIG. 25 shows a top view of a concentric hexagon configuration for climbing matrices.
Figure 26:
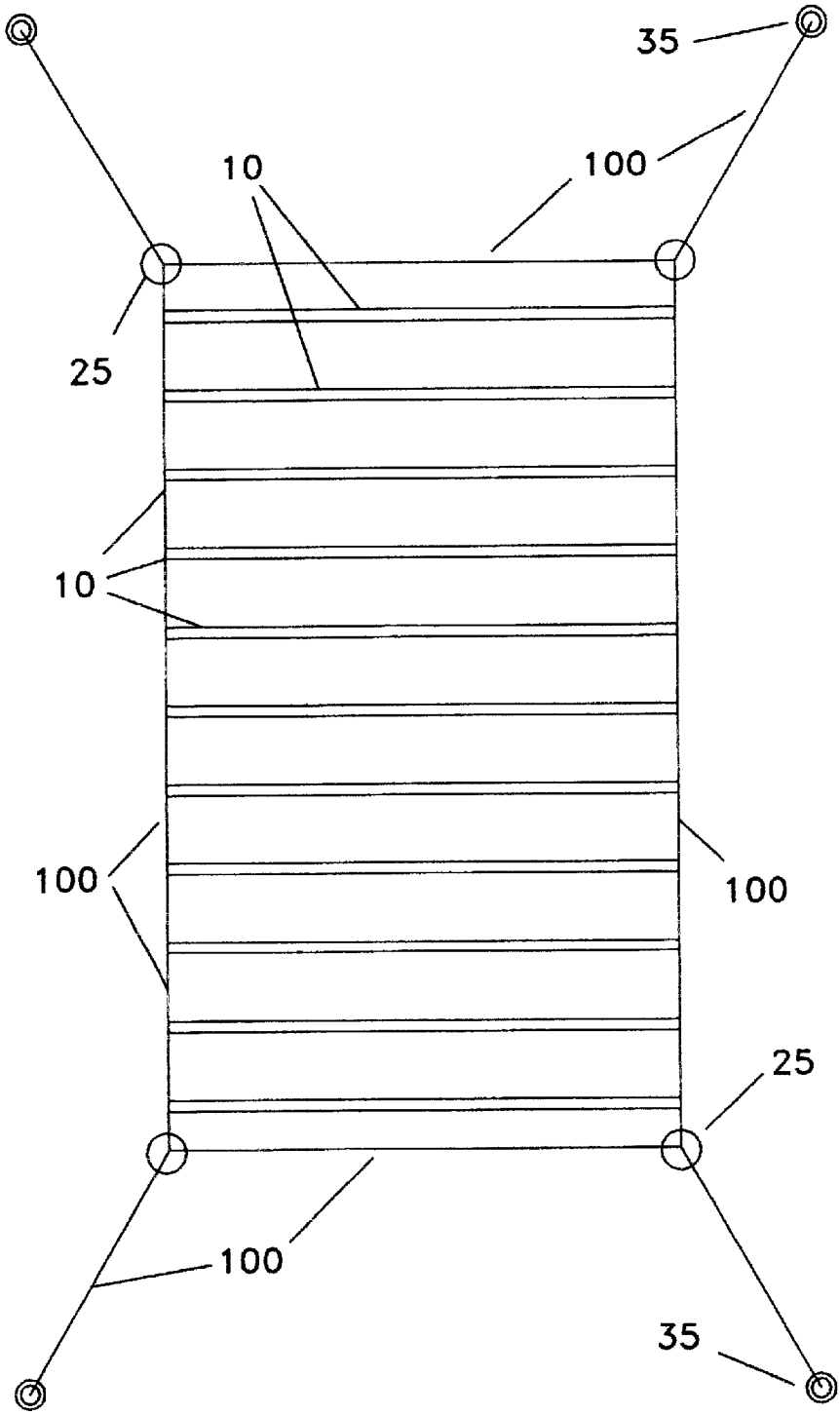
FIG. 26 shows a top view of a multiple-row configuration for climbing matrices.

FIGS. 25 and 26 show configurations which maximize the amount of approximately vertical-surface climbing area in a given "footprint" (i.e., ground area) of the apparatus. FIG. 25 shows a top view of a concentric hexagon configuration for vertical climbing matrices 10 which are hung from cables 100 which interconnect the top of the center support pole 25 to the tops of the perimeter support poles 25 and which then extend down to ground anchors 35. There are three hexagon-shaped pliable climbing matrices 10, each of which can be climbed on both sides. FIG. 26 shows a top view of a multiple-row configuration for vertical climbing matrices 10 which are hung from two cables 100 each of which are strung back and forth between two cables 100 interconnecting the tops of two support pole 25 and which then extend down to ground anchors 35. The examples shown herein are only a few of any number of possible shapes and configurations inclusive in the current application—provided they utilize pliable climbing matrices 10 mounted with rock-climbing/gymnastic holds 20.

Figure 27:
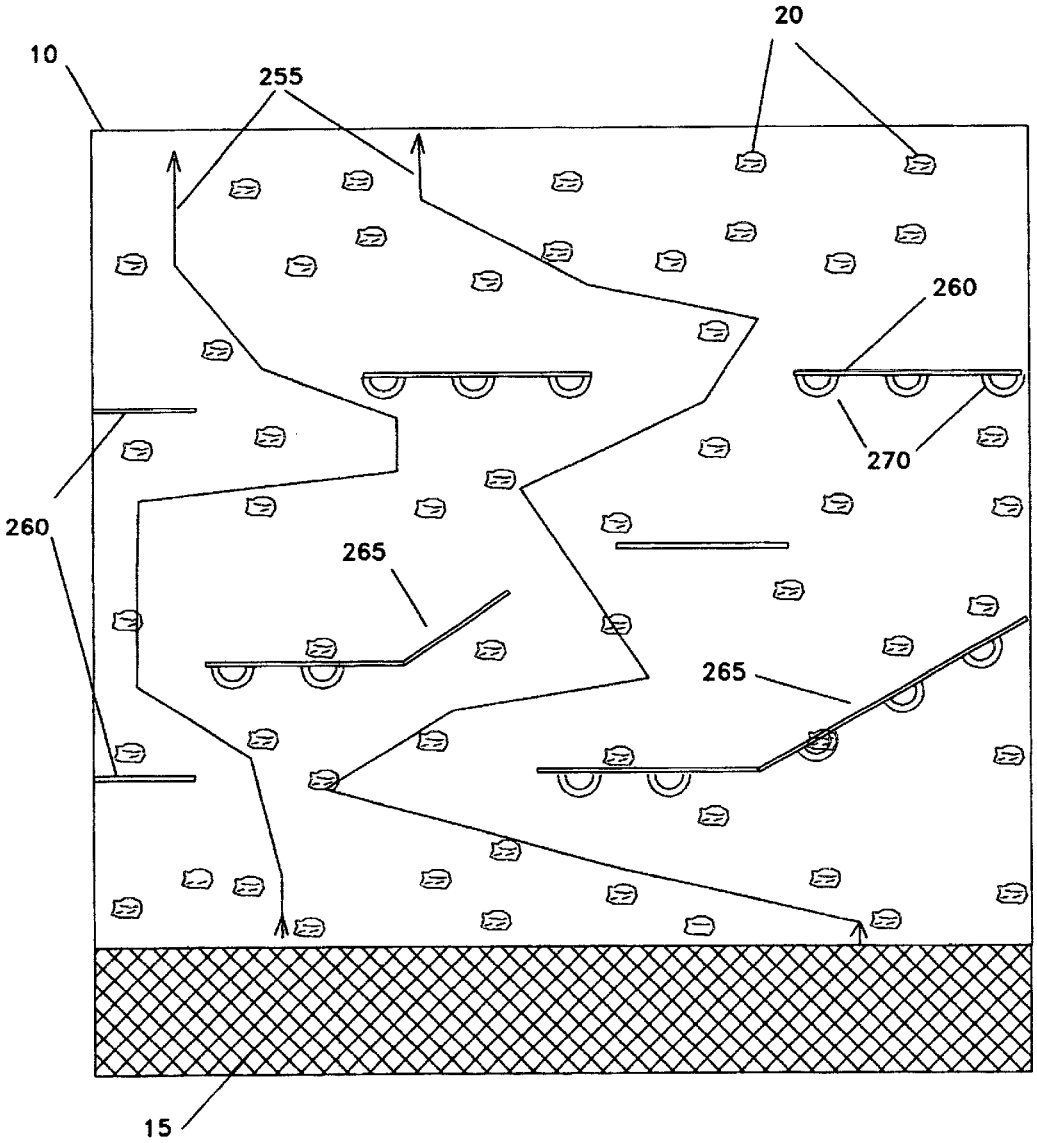
FIG. 27 shows a front view of staggered safety ledges and safety ramps on a vertical climbing matrix.
Figure 28:
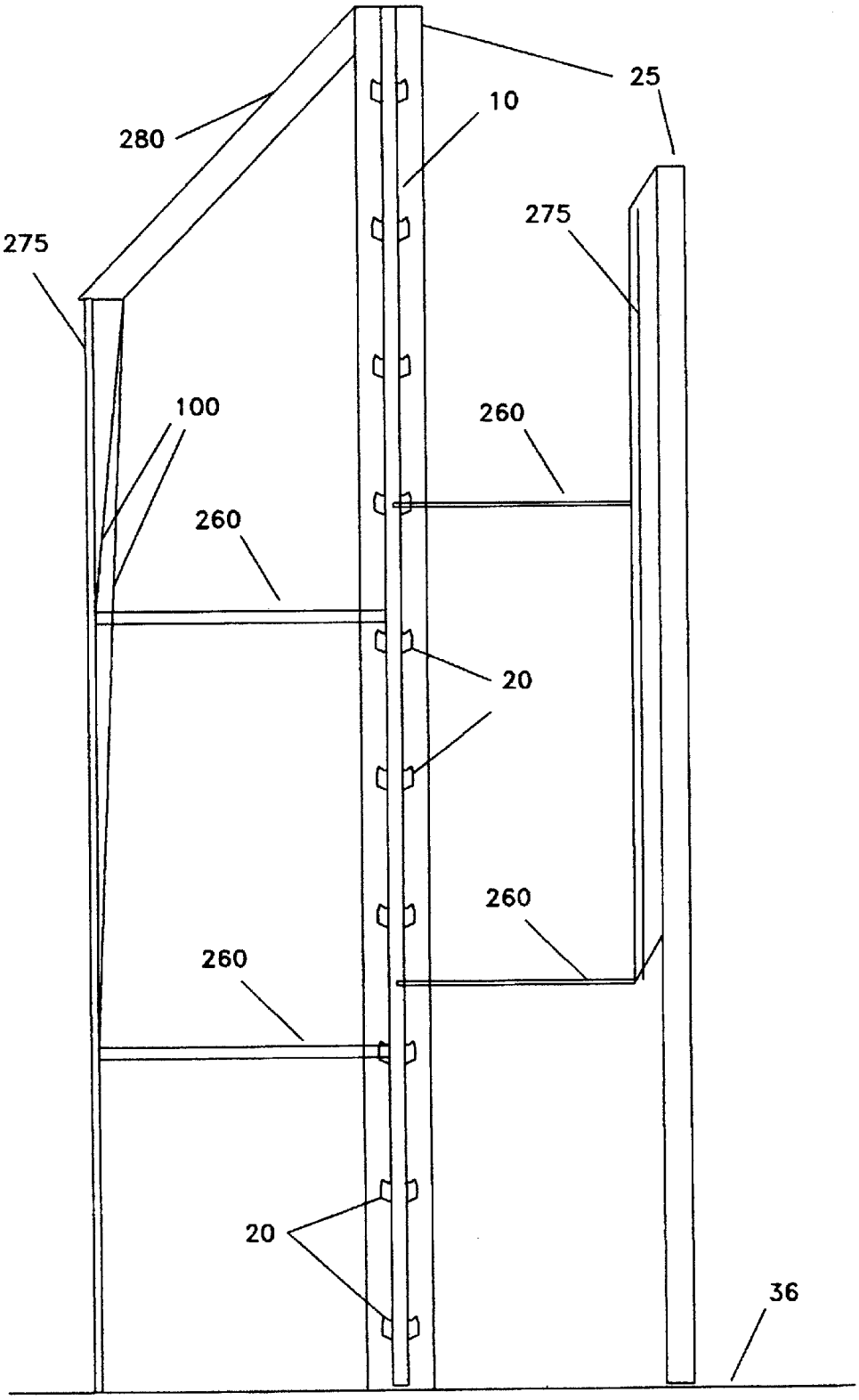
FIG. 28 shows a side view of a safety ledge with its support poles and a wall restraint.

FIG. 27 shows a front view of staggered safety ledges 260 and safety ramps 265 on a vertical climbing matrix 10 as well as overhanging holds 270 affixed to the bottom of safety ledges 260. These safety features allow a climber to safely climb a long route on a vertical climbing matrix 10, as indicated by the arrowed lines which trace climbing routes 255. That is, wherever a climber may fall, there is some safety ledge 260, safety ramp 265, or safety surface 15 to safely arrest her fall. For simplicity of viewing the supports for the safety features in FIG. 27 are not shown. FIG. 28 shows a side view of safety ledges 260. On the right side of the figure, safety ledges 260 are held in tension and supported between a center support pole 25 and a side support pole 25. An additional safety feature can be incorporated into the invention, namely wall restraints 275 which are hung on the side support pole 25, which attach to safety ledge 260, and which prevent a climber from falling off safety ledge 260 to the ground 36. An alternative method of support safety ledges 260 is shown on the left side of the figure. Here, safety ledges 260 are hung from top beam 280 which is rigidly attached to the top of the center support pole 25; this eliminates the need for side support pole 25, on this left side. The various cables needed to keep support poles 25 erect are not shown here, again to simplify viewing.

Figure 29:
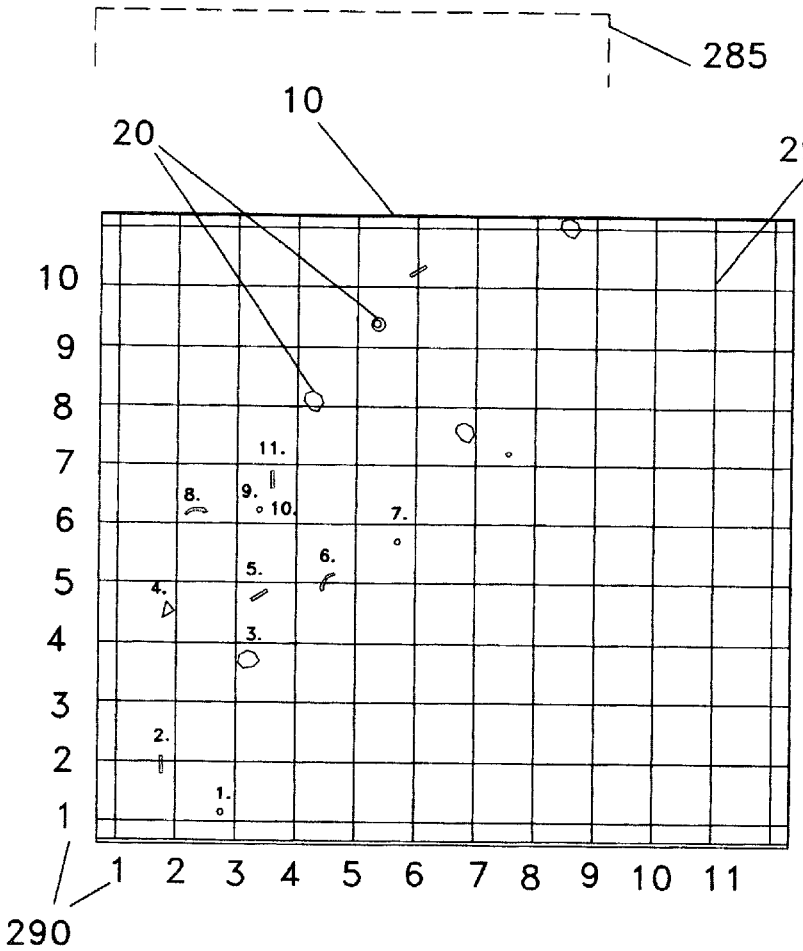
FIG. 29 shows a sample climbing route map which can be scaled for climbers of various heights thereby taking advantage of the positionability of the rock-climbing/gymnastic holds.

FIG. 29 shows sample climbing-route map 285 which takes advantage of the positionability of rock-climbing/gymnastic holds 20. In addition to marking locations of the various rock-climbing/gymnastic holds 20 with a map, the distances between the various rock-climbing/gymnastic holds 20 can be scaled (The meaning of scale here is not to climb but rather to adjust proportionally in size.)—allowing climbers of various heights to climb the route. For example, a shorter climber would not be able to reach certain "long-reach" rock-climbing/gymnastic holds 20 unless the route has been scaled down in size. The "reach distance" (i.e., the distance between the upwardly stretched fingers and the toes of a climber) is a good parameter to use for the scaling. In this case, the ratio of reach distances for two different climbers is used to scale the size of climbing-route map 285 (i.e., the distances between all holds). At least two methods can be used to set a particular climbing-route map 285 for a climber with a particular "reach distance." In the first method, x-y grid 290 is marked on climbing matrix 10, allowing each position to be labeled by a vertical position and a horizontal position. Route table 295, which labels each rock-climbing/gymnastic hold 20 by type, orientation, vertical position, and horizontal position, would then allow any user to set a climbing route defined by climbing-route map 285 and a scale value.

Figure 30:
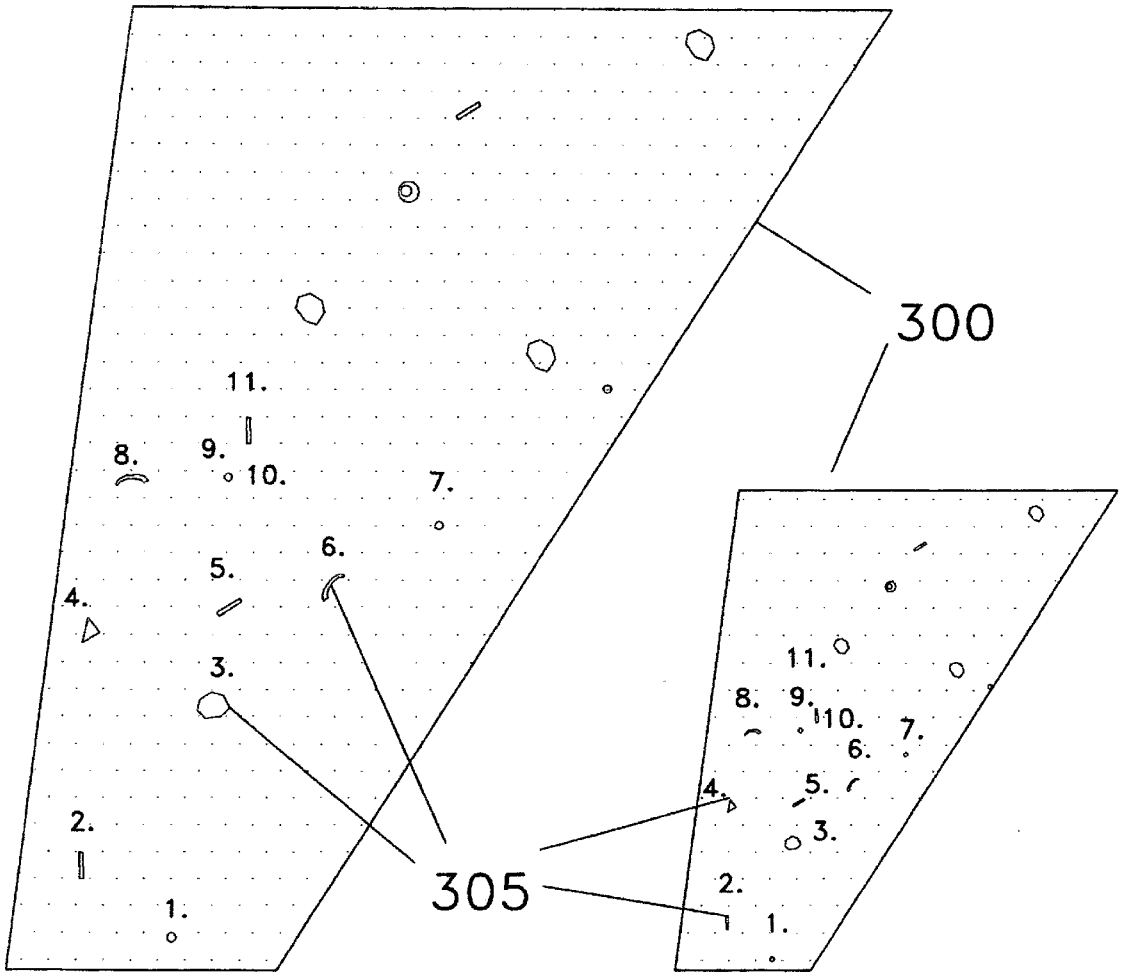
FIG. 30 shows climbing route patterns for scaling routes to climbers of various sizes.

In the second method, a pattern would be available for a certain size climber (i.e., a particular scale value) with the positions and types of each holds shown on the pattern by hold markers 305. FIG. 30 shows climbing route patterns 300, one of which is scaled to 0.5 times the size of the other. These climbing route patterns 300 would be draped over climbing matrix 10, and then each rock-climbing/gymnastic hold 20 would be set or mounted at the corresponding position (to hold markers 305) onto climbing matrix 10. Climbing route patterns 300 now constitute climbing-route map 285 of FIG. 29, and they could be made of paper or mesh which could be folded or rolled for storage. The advantage of this route-setting capability is that experts can set routes which are interesting, challenging, and safe. Accordingly, climbers can vary their routes to keep their climbing interesting, and they can get an idea of the standard at which they are climbing. This idea of scalable climbing-route maps is novel, and can be claimed independently of the ultra-light rock-climbing wall invention.

It should be understood that there are many ways to make the ultra-light rock-climbing structure by combining the above-mentioned features, and these examples shall not be construed as limiting the ways in which these can be practiced but shall be inclusive of many other variations that do not depart from the broad interest and intent of the invention.

Having thus described the invention, what is claimed as new and desired to be secured by Letters Patent is:

1. A rock-climbing structure comprising:

at least one pliable climbing matrix held under tension;

a plurality of rock-climbing/gymnastic holds attached to the at least one pliable climbing matrix, at least one elevated structure, and at least one tension anchor, wherein the at least one pliable climbing matrix is supported in tension between upper sections of the at least one elevated structure and the at least one tension anchor, and wherein the rock-climbing/gymnastic holds are attached to a variable portion of the at least one pliable climbing matrix.

2. The rock-climbing structure of claim 1, wherein the at least one tension anchor is located in the center of the rock-climbing structure surrounded by the at least one elevated structure.

3. The rock-climbing structure of claim 1, wherein the at least one elevated structure is located in the center of the rock-climbing structure surrounded by the at least one tension anchor.

4. The rock-climbing structure of claim 1, wherein the at least one elevated structure comprises at least one support pole.

5. The rock-climbing structure of claim 1, wherein the at least one elevated structure comprises at least one pre-existing object.

6. The rock-climbing structure of claim 1, wherein the at least one tension anchor comprises at least one ground anchor.

7. A rock-climbing structure comprising:

at least one pliable climbing matrix held under tension, and a plurality of rock-climbing/gymnastic holds attached to the at least one pliable climbing matrix, wherein the at least one pliable climbing matrix is a combination in variable portions of at least two of fabric, mesh, netting, lacework of at least one of cable and cord, a thin solid sheet, and a void, wherein the proportion of the whole of each of these materials varies from zero to one hundred percent.

8. A rock-climbing structure comprising:

at least one pliable climbing matrix held under tension;

a plurality of rock-climbing/gymnastic holds attached to the at least one pliable climbing matrix, and at least one climbing-route map which provides a means to position the plurality of rock-climbing/gymnastic holds to create a prescribed climbing route, wherein the climbing route is scalable according to a climber's size.

9. A rock-climbing structure comprising:

at least one pliable climbing matrix held under tension, wherein the at least one pliable climbing matrix is adapted to be folded up;

a plurality of holds attached to the at least one climbing matrix; and a means for attaching the holds to the pliable climbing matrix, wherein distances between each hold of the plurality of holds vary across the at least one climbing matrix to create a varied climbing route across the at least one climbing matrix.

10. The rock-climbing structure of claim 9, wherein the at least one pliable climbing matrix is a sheet.

11. The rock-climbing structure of claim 9, wherein the at least one pliable climbing matrix is one of a net and a mesh.

12. The rock-climbing structure of claim 9, wherein the climbing route is adapted to permit a climber to move horizontally and vertically across the at least one pliable climbing matrix.

13. The rock-climbing structure of claim 9, wherein a portion of the plurality of climbing holds are marked to define a particular climbing route.

14. The rock-climbing structure of claim 9, wherein the means for attaching comprises a clasp rod attached to an individual hold of the plurality of holds, and wherein the at least one pliable matrix is clamped between the clasp rod and the individual hold.

15. The rock-climbing structure of claim 9, wherein the at least one pliable matrix is a net having a plurality of vertical cords, and wherein the means for attaching comprises clamps that engage at least one of the plurality of vertical cords.

16. The rock-climbing structure of claim 9, wherein the plurality of holds include one of a hold edge, a jib hold, a hold hole, a hold lip, a hold crack, and a hold boss.

17. The rock-climbing structure of claim 9, wherein the plurality of holds comprises gymnastic hold, that swing from the at least one pliable climbing matrix.

18. The rock-climbing structure of claim 9, wherein the plurality of holds comprises suspension holds that are suspended from the at least one pliable climbing matrix such that the suspension hold are constrained from swinging.

19. The rock-climbing structure of claim 9 further comprising:

at least one elevated structure, and at least one tension anchor, wherein the at least one pliable climbing matrix is supported in tension between the at least one elevated structure and the at least one tension anchor.

20. The rock-climbing structure of claim 19, wherein the at least one elevated structure supports the center of the at least one pliable climbing matrix and the at least one tension anchor anchors the perimeter of the at least one pliable climbing matrix.

21. The rock-climbing structure of claim 19, wherein the at least one tension anchor is located in the center of said rock-climbing structure surrounded by the at least one elevated structure.

22. The rock-climbing structure of claim 19, wherein the at least one elevated structure comprises at least one support pole.

23. The rock-climbing structure of claim 19, wherein the at least one elevated structure comprises at least one space-truss support.

24. The rock-climbing structure of claim 19, wherein the at lest one elevated structure comprises a pre-existing elevated structure.

25. The rock-climbing structure of claim 19, wherein the at least one tension anchor is a ground anchor.

26. The rock-climbing structure of claim 19, wherein the at least one tension anchor comprises a pre-existing object.

27. The rock-climbing structure of claim 19, wherein the at least one tension anchor comprises a portable ground framework.

28. The rock-climbing structure of claim 9, further comprising at least one safety surface, wherein the at least one safety surface is located beneath the at least one pliable climbing matrix.

29. The rock-climbing structure of claim 28, wherein the at least one safety surfaces comprises a safety net.

30. The rock-climbing structure of claim 28, wherein the at least one safety surface comprises an inflatable base.

31. The rock-climbing structure of claim 9, wherein an upper pliable climbing matrix of the at least one pliable climbing matrix is located above a lower pliable climbing matrix of the at least one pliable climbing matrix, and wherein the lower pliable climbing matrix has a portal.

32. The rock-climbing structure of claim 9 wherein the at least one pliable climbing matrix includes at least one of a sheet, a mesh, a netting, a lacework, a thin solid sheet, and a void.

33. The rock-climbing structure of claim 9, further comprising at least one climbing-route map for positioning the plurality of holds to create a prescribed climbing route, wherein the climbing route is scalable.

* * * * *